US007758394B2

(12) United States Patent
Shaw et al.

(10) Patent No.: US 7,758,394 B2
(45) Date of Patent: Jul. 20, 2010

(54) SPORTING SYSTEM

(76) Inventors: Robert Neil Shaw, 157 Sans Rd., Watsonville, CA (US) 95076; Eugene Christopher Shaw, 157 Sans Rd., Watsonville, CA (US) 95076; Tami Lynn Saucedo, 1920 S. Columbia St., Seaside, OR (US) 97138; Anne Marie Shaw, 157 Sans Rd., Watsonville, CA (US) 95076

( * ) Notice: Subject to any disclaimer, the term of this patent is extended or adjusted under 35 U.S.C. 154(b) by 0 days.

(21) Appl. No.: 11/604,100

(22) Filed: Nov. 22, 2006

(65) Prior Publication Data

US 2007/0218714 A1 Sep. 20, 2007

Related U.S. Application Data

(60) Provisional application No. 60/783,328, filed on Mar. 17, 2006, provisional application No. 60/784,359, filed on Mar. 20, 2006, provisional application No. 60/785,640, filed on Mar. 24, 2006, provisional application No. 60/786,461, filed on Mar. 28, 2006, provisional application No. 60/831,816, filed on Jul. 18, 2006.

(51) Int. Cl.
*B63B 1/00* (2006.01)

(52) U.S. Cl. ..... 441/75; 36/114

(58) Field of Classification Search ..... 441/65, 441/74, 75; 114/39.12, 91; 36/114
See application file for complete search history.

(56) References Cited

U.S. PATENT DOCUMENTS

| | | | | |
|---|---|---|---|---|
| 4,108,452 A | | 8/1978 | Baron | |
| 4,285,082 A | | 8/1981 | Cox | |
| 4,645,466 A | | 2/1987 | Ellis | |
| 4,924,608 A | | 5/1990 | Mogonye | |
| 4,939,851 A | | 7/1990 | Miller | |
| 5,454,743 A | | 10/1995 | Simonson | |
| 5,628,266 A | * | 5/1997 | Jurriens et al. | 114/39.16 |
| 5,766,051 A | | 6/1998 | Messer | |
| 6,003,745 A | * | 12/1999 | Mechanic | 224/156 |
| 6,969,290 B2 | | 11/2005 | Shaw | |
| 2002/0136846 A1 | * | 9/2002 | Prevost | 428/17 |
| 2003/0056395 A1 | | 3/2003 | Berggren | |
| 2005/0120587 A1 | * | 6/2005 | Helton et al. | 36/3 B |

FOREIGN PATENT DOCUMENTS

| | | | |
|---|---|---|---|
| DE | 3111227 | A1 | 9/1982 |
| EP | 1 334 668 | A1 | 8/2003 |
| WO | WO 98/42562 | | 10/1998 |
| WO | WO 2004/103491 | A2 | 12/2004 |
| WO | WO 2005/025359 | A1 | 3/2005 |

OTHER PUBLICATIONS

PCT International Search Report and Written Opinion of the International Searching Authority, International Application No. PCT/US2007/005912; International Filing Date, Mar. 7, 2007; mailing date, Sep. 27, 2007 (15 pp.).

Velcro, Wikipedia, Aug. 10, 2009, 8 pages, http://en.wikipedia.org/wiki/Velcro.

* cited by examiner

*Primary Examiner*—Stephen Avila
(74) *Attorney, Agent, or Firm*—Blakely Sokoloff Taylor & Zafman LLP

(57) ABSTRACT

A sporting system is described, having a sport board that can be attached to a shoe construction using Velcro®.

28 Claims, 13 Drawing Sheets

SPORTING SYSTEM

CROSS-REFERENCE TO RELATED APPLICATIONS

This application claims priority from U.S. Provisional Patent Application No. 60/783,328, filed on Mar. 17, 2006; U.S. Provisional Patent Application No. 60/784,359, filed on Mar. 20, 2006; U.S. Provisional Patent Application No. 60/785,640, filed on Mar. 24, 2006; U.S. Provisional Patent Application No. 60/786,461, filed on Mar. 28, 2006; and U.S. Provisional Patent Application No. 60/831,816, filed on Jul. 18, 2006, all of which are incorporated herein by reference in their entirety.

BACKGROUND OF THE INVENTION

1). Field of the Invention

This invention relates to a sporting system and to a shoe system.

2). Discussion of Related Art

Enthusiasts often engage in various types of sport-boarding, such as wake-skating, wake-boarding, surfing, skate-boarding, kite-boarding, and the like. In each case, a person can stand up on a board, and the board be used as a vehicle, be it a rider of a wake-skate board or a wake-board, a surfer on a surfboard, a skateboarder on a skateboard, etc. A wake-skater and skateboarder are typically not attached to the board, which limits the number of tricks that the wake-skater or skateboarder can perform. A wake-boarder is typically attached to a wake-board by making use of boots and bindings. Such boots can be difficult to put on or remove, and their use can be painful. It can also be a cumbersome task to attach the boots to the bindings, and the bindings do not allow for on-the-fly adjustment of the positioning of the boots. The boots also cannot be used for easy walking.

SUMMARY OF THE INVENTION

The invention provides a sporting system, including a board having upper and lower major surfaces, and a first attachment device in the form of a plurality of attachment members having lower ends attached to the upper major surface of the board, and upper ends that are hook-shaped for purposes of removable attachment to a second attachment device in the form of loop material.

The board may be at least partially made of a buoyant material to keep the board at least partially above water.

The sporting system may further include a hook backing material, the lower ends of the attachment members being attached to the hook backing material, the hook backing material being attached to the upper major surface of the board.

The sporting system may further include a first adhesive between the hook backing material and the upper major surface of the board.

The sporting system may further include an intermediate sheet having upper and lower major sides, a second attachment device in the form of loop material on the lower major surface of the intermediate sheet for removable attachment to the first attachment device, a third attachment device in the form of loop material on the upper major surface of the intermediate sheet, a footpiece to be worn on a foot of a person, and a fourth attachment device in the form of a plurality of attachment members having upper ends attached to a sole portion of the footpiece, and lower ends that are hook-shaped for purposes of removable attachment to the loop material of the second attachment device.

The intermediate sheet may have a surface area that is larger than a surface area of the sole portion of the footpiece.

The intermediate sheet may be a first intermediate sheet, and the loop material of the second attachment device may be attached to the first intermediate sheet, further including a second intermediate sheet, the loop material of the third attachment device being attached to the second intermediate sheet, a lower major surface of the second intermediate sheet being attached to an upper major surface of the first intermediate sheet.

The footpiece, in addition to the sole portion, may include a shoe upper that is peripherally attached to the sole portion and defining a foot opening for inserting the foot, and a plurality of eyelets, a tongue attached to the shoe upper, and a lace that is threaded through the eyelets in a zig-zag pattern across the tongue.

The sole portion may have a vertical and a horizontal drain opening to allow for removal of water from within the footpiece.

The sporting system may further include hook backing material, the upper ends of the attachment members of the fourth attachment device being attached to the hook backing material, an upper major surface of the hook backing material being attached to the sole portion of the footpiece.

The sporting system may further include a sole member, having upper and lower major surfaces, and a fifth attachment device in the form of loop material on the upper major surface of the sole member for purposes of removable attachment to the fourth attachment device, after removal of the fourth attachment device from the second attachment device.

The lower major surface of the sole member may be substantially free of attachment devices that will prevent the board from separating from the footpiece under gravity.

The sporting system may further include a wake-skating sheet, having upper and lower major surfaces, and a second attachment device in the form of loop material on a lower major surface of the wake-skating sheet, for removable attachment to the first attachment device.

The upper major surface of the wake-skating sheet may be exposed and substantially free of attachment devices that will prevent the board from separating from a footpiece under gravity.

The sporting system may further include loop backing material, the loop material of the second attachment device being secured to the loop backing material, an upper major surface of the loop backing material being attached to a lower major surface of the wake-skating sheet.

The invention also provides a sporting system, including a board having upper and lower major surfaces, a first attachment device attached to the upper major surface of the board, a footpiece to be worn on a foot of a person, a second attachment device on the footpiece for removable attachment to the first attachment device, a wake-skating sheet of material having upper and lower major surfaces, and a third attachment device on the lower major surface of the wake-skating sheet for removable attachment to the first attachment device after detachment of the second attachment device from the first attachment device.

The upper major surface of the wake-skating sheet may be exposed and substantially free of attachment devices that will prevent the board from separating from a footpiece under gravity.

The invention further provides a sporting system, including a board having upper and lower major surfaces, a first attachment device attached to the upper major surface of the board, a footpiece to be worn on a foot of a person, a second attachment device on a sole portion of the footpiece, for removable attachment to the first attachment device, wherein the second attachment device has a surface area that is larger than the surface area of the sole portion of the footpiece.

The invention further provides a sporting conversion kit, including a first attachment device permanently attachable to an upper major surface of a board, an intermediate sheet, having upper and lower major surfaces, a second attachment device on the lower major surface of the intermediate sheet for removable attachment to the first attachment device, a third attachment device on the upper major surface of the intermediate sheet for removable attachment to a fourth attachment device on a footpiece worn on a foot of a person, and a container holding the first attachment device and the intermediate sheet with the second and third attachments devices therein.

The sporting conversion kit may further include a hook backing sheet, the first attachment device being a plurality of attachment members, each having a lower end attached to the hook backing sheet, and an upper end that is hook-shaped, the second attachment device being loop material.

The third attachment device may be loop material.

The sporting conversion kit may further include an adhesive on a lower major surface of the hook backing sheet, and a cover sheet adhering to the adhesive and being removable from the adhesive to allow for attachment of the adhesive to a board.

The invention further provides a sporting system, including a board having upper and lower major surfaces, a first attachment device attached to the upper major surface of the board, first and second outside intermediate sheets, each having upper and lower major sides, a second attachment device on the lower major surface of each outer intermediate sheet for removable attachment to the first attachment device, a third attachment device on the upper major surface of each outer intermediate sheet for removable attachment to a fourth attachment device on a respective footpiece worn on a foot of a person, an inner attachment sheet, having upper and lower major sides, and a fourth attachment device, which is the same as the second attachment device, on the lower side major surface of the inner intermediate sheet for removable attachment to the first attachment device, so that the inner intermediate sheet is located between the first and second outside intermediate sheets, and the upper major surface of the inner intermediate sheet is exposed and substantially free of attachment devices that will prevent the board from separating from a footpiece under gravity.

The sporting system may further include a hook backing material, the lower ends of the attachment members being attached to the hook backing material, the hook backing material being attached to the upper major surface of the board.

The sporting system may further include a first adhesive between the hook backing material and the upper major surface of the board.

The second attachment device may be loop material, and the third attachment device may also be loop material.

The sporting system may further include a footpiece to be worn on a foot of a person, and a fifth attachment device attached to a sole portion of the footpiece for purposes of removable attachment to the third attachment device.

The intermediate sheet may have a surface area that is larger than a surface area of the sole portion of the footpiece.

The footpiece, in addition to the sole portion, may include a shoe upper that is peripherally attached to the sole portion and defining a foot opening for inserting the foot, and a plurality of eyelets, a tongue attached to the shoe upper, and a lace that is threaded through the eyelets in a zig-zag pattern across the tongue.

The sole portion may have a vertical and a horizontal drain opening to allow for removal of water from within the footpiece.

The sporting system may further include hook backing material, the upper ends of the attachment members of the fourth attachment device being attached to the hook backing material, an upper major surface of the hook backing material being attached to the sole portion of the footpiece.

The sporting system may further include a sole member having upper and lower major surfaces, and a fifth attachment device in the form of loop material on the upper major surface of the sole member for purposes of removable attachment to the fourth attachment device, after removal of the fourth attachment device from the second attachment device.

The lower major surface of the sole member may be substantially free of attachment devices that will prevent the board from separating from the footpiece under gravity.

The invention further provides a sporting system, including a board having upper and lower major surfaces, and having threaded openings into the upper major surface, a first attachment device attached to the upper major surface of the board, the first attachment device leaving the threaded openings exposed, an intermediate sheet, having upper and lower major surfaces, a second attachment device on the lower major surface of the intermediate sheet for removable attachment to the first attachment device, and a third attachment device on the upper major surface of the intermediate sheet for removable attachment to a fourth attachment device on a footpiece worn on a foot of a person.

The intermediate sheet may have at least one hole therein, that leaves at least one of the threaded openings exposed.

The sporting system may further include a hook backing material, the lower ends of the attachment members being attached to the hook backing material, the hook backing material being attached to the upper major surface of the board.

The sporting system may further include a first adhesive between the hook backing material and the upper major surface of the board.

The second attachment device may be loop material, and the third attachment device may be loop material.

The sporting system may further include a footpiece to be worn on a foot of a person, and a fifth attachment device attached to a sole portion of the footpiece for purposes of removable attachment to the third attachment device.

The intermediate sheet may have a surface area that is larger than a surface area of the sole portion of the footpiece.

The footpiece, in addition to the sole portion, may include a shoe upper that is peripherally attached to the sole portion and defining a foot opening for inserting the foot, and a plurality of eyelets, a tongue attached to the shoe upper, and a lace that is threaded through the eyelets in a zig-zag pattern across the tongue.

The sole portion may have a vertical and a horizontal drain opening to allow for removal of water from within the footpiece.

The sporting system may further include hook backing material, the upper ends of the attachment members of the fourth attachment device being attached to the hook backing material, an upper major surface of the hook backing material being attached to the sole portion of the footpiece.

The sporting system may further include a sole member having upper and lower major surfaces, and a fifth attachment device in the form of loop material on the upper major surface of the sole member for purposes of removable attachment to the fourth attachment device, after removal of the fourth attachment device from the second attachment device.

The lower major surface of the sole member may be substantially free of attachment devices that will prevent the board from separating from the footpiece under gravity.

The invention further provides a sporting system, including a board having upper and lower major surfaces, a first attachment device attached to the upper major surface of the board, at least a first upper traction pad having upper and lower major surfaces, and a second attachment device on the lower major surface of the upper traction pad, for removable attachment to the first attachment device, the upper major surface of the first upper traction pad being exposed and substantially free of attachment devices that will prevent the board from separating from a shoe under gravity.

The upper major surface of the first upper traction pad may be a non-slip surface.

The sporting system may further include at least a second upper traction pad having upper and lower major surfaces, a third attachment device on the lower major surface of the upper traction pad for removable attachment to the first attachment device, the upper major surface of the second upper traction pad being exposed and substantially free of attachment devices that will prevent the board from separating from a shoe under gravity.

The upper major surfaces of the first and second upper traction pads may have different profiles.

The first and second upper traction pads may be simultaneously attached to the first attachment device at different locations on the upper major surface of the board.

The board may be at least partially made of a buoyant material to keep the board at least partially above water.

The sporting system may further include a hook backing material, the first attachment device being a plurality of attachment members, each having a lower end attached to the hook backing material, and an upper end that is hook-shaped, the second attachment device being loop material.

The sporting system may further include a first adhesive between the hook backing material and the upper major surface of the board.

The invention further includes a shoe system, including a footpiece worn on a foot of a person, a first attachment device on the footpiece, a first sole member, having upper and lower major surfaces, a second attachment device on the first sole member, for removable attachment to the first attachment device, a second sole member, having upper and lower major surfaces, and a third attachment device on the second sole member, for removable attachment to the first attachment device, the lower major surface of the first sole member providing better traction on a first select surface than the lower major surface of the second sole member.

The lower major surface of the second sole member may provide better traction on a second select surface than the first sole member.

The lower major surface of the first sole member may include a plurality of protrusions, and the lower major surface of the second sole member may not include a plurality of protrusions.

The footpiece may include a sole portion, a shoe upper that is peripherally attached to the sole portion and defining a foot opening for inserting the foot, and a plurality of eyelets, a tongue attached to the shoe upper, and a lace that is threaded through the eyelets in a zig-zag pattern across the tongue.

At least one of the first attachment device, the second attachment device, and the third attachment device may include a loop material, and one of the first attachment device, the second attachment device, and the third attachment device may include hook material.

BRIEF DESCRIPTION OF THE DRAWINGS

The invention is described by way of examples with reference to the accompanying drawings, wherein.

DETAILED DESCRIPTION OF THE INVENTION

As used herein, the terms "person," "rider," "purchaser," "surfer," etc. may be the same person performing different functions.

Figure 1:
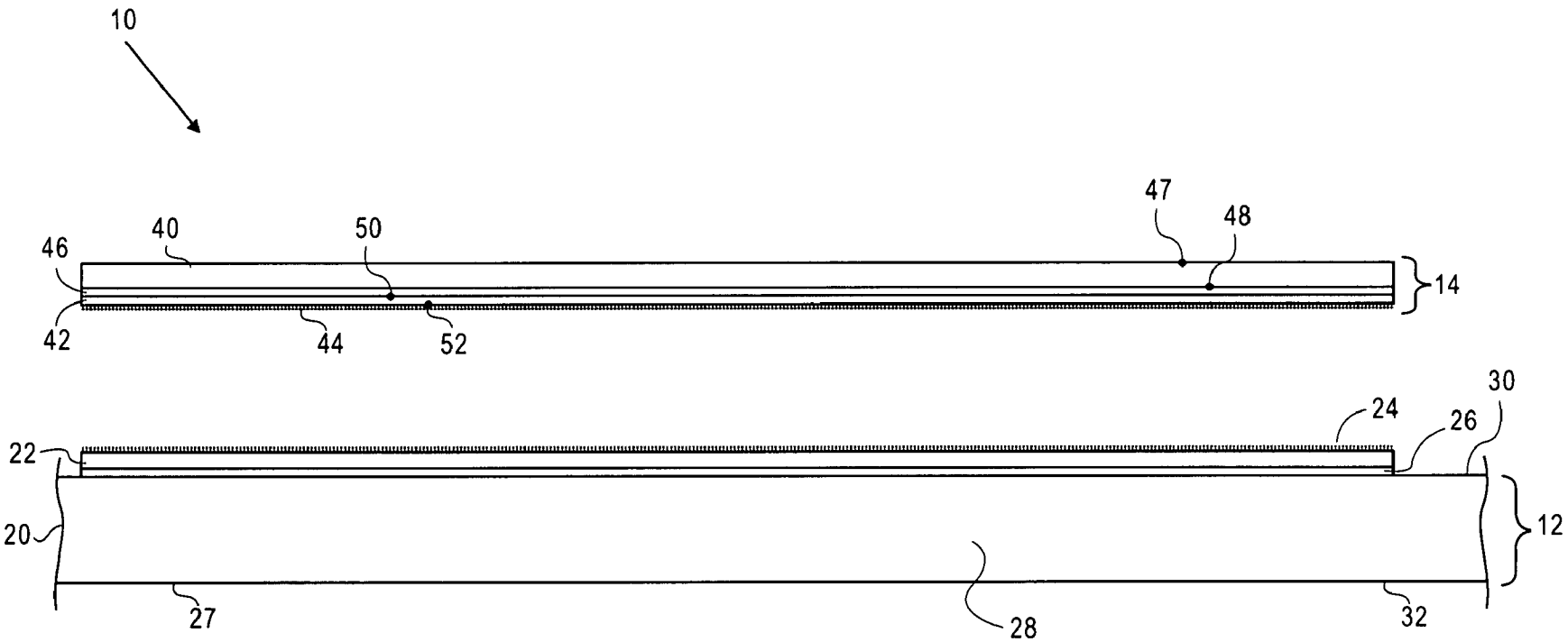
FIG. 1 is a side view of a portion of a sporting system, according to one embodiment of the invention, including a board construction and a wake-skating sheet construction.
Figure 2:
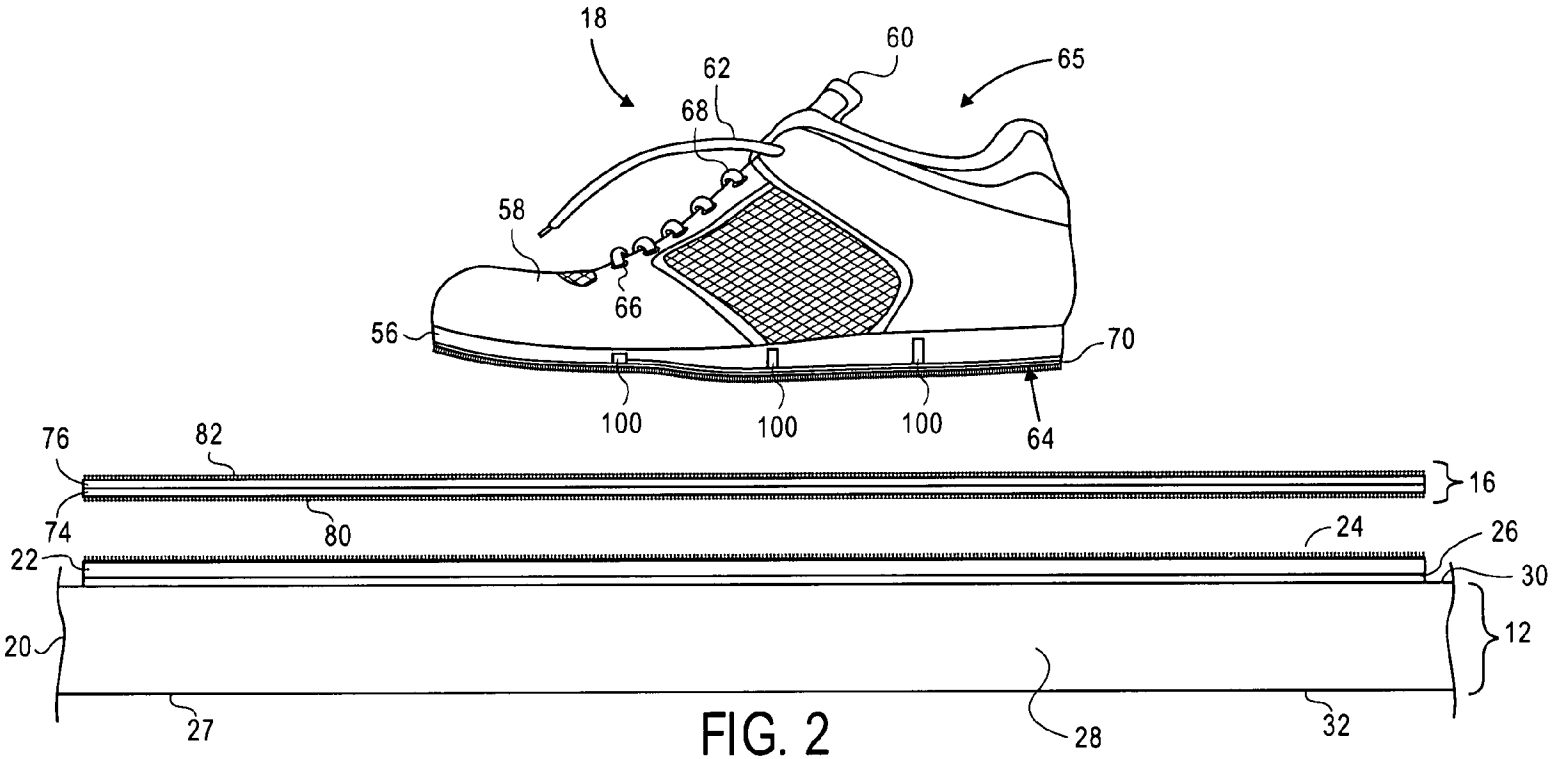
FIG. 2 is a side view of the sporting system of FIG. 1 in a different configuration, including the board construction, an intermediate sheet construction, and a shoe construction.

FIG. 1 of the accompanying drawings illustrates components of a sporting system 10, according to an embodiment of the invention, including a board construction 12 and a wake-skating sheet construction 14. FIG. 2 shows the sporting system 10 in a different configuration, including the board construction 12, an intermediate sheet construction 16, and a shoe construction 18.

Referring to FIG. 1, the board construction 12 includes a sport board 20, a hook backing material 22, attachment members 24, and adhesive 26.

The sport board 20 has an outer shell 27, and an inner core 28 made of Styrofoam or another buoyant material that keeps the board construction 12 afloat with at least a portion of the board construction 12 above water. The sport board 20 has an upper major surface 30 and a lower major surface 32.

Figure 3:
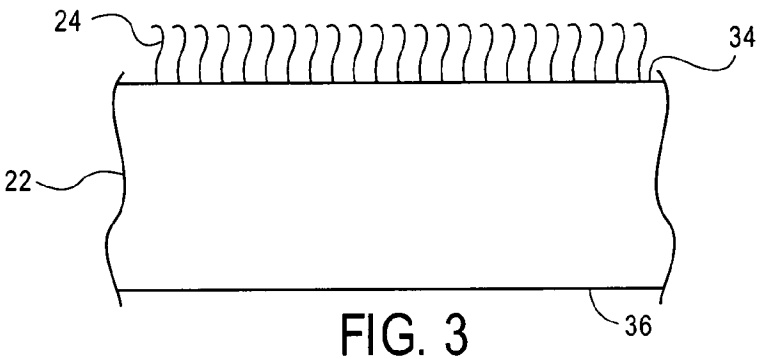
FIG. 3 is a side view illustrating hook-type Velcro® forming part of the sporting system of FIGS. 1 and 2 in enlarged detail.

FIG. 3 illustrates the hook backing material 22 and the attachment members 24 in more detail. The hook backing material 22 has upper and lower major surfaces 34 and 36 respectively. Each attachment member 24 has a lower end that is attached to the hook backing material 22, and an upper end that is hook-shaped. The combination of the attachment members 24 and the hook backing material 22 is commonly known as "hook-type Velcro®." Referring to FIGS. 1 and 3 in combination, the adhesive 26 is located between and attaches the lower major surface 36 of the hook backing material 22 to the upper major surface 30 of the sport board 20. The attachment members 24 thus have lower ends that are secured through the hook backing material 22 and the adhesive 26 to the upper major surface 30 of the sport board 20. The attachment members 24 hence form an attachment device on the sport board 20.

Referring specifically to FIG. 1, the wake-skating sheet construction 14 includes a wake-skating sheet 40, a loop backing material 42, loop material 44, and an adhesive 46.

The wake-skating sheet 40 is made of a synthetic rubber material or another relative flexible material compared to the sport board 20. The wake-skating sheet 40 has upper and lower major surfaces 47 and 48.

The loop backing material 42 has upper and lower major surfaces 50 and 52. The loop material 44 is attached to the lower major surface 52 of the loop backing material 42. The combination of the loop backing material 42 and the loop material 44 is commonly known as "loop-type Velcro®." The adhesive 46 is located between the upper major surface 50 of the loop backing material 42 and the lower major surface 48 of the wake-skating sheet 40, and attaches the loop backing material 42 to the wake-skating sheet 40. The loop material 44 is thus attached through the loop backing material 42 and the adhesive 46 to the lower major surface 48 of the wake-skating sheet 40. The wake-skating sheet 40 is thus provided with an attachment device in the form of the loop material 44 on a lower side thereof.

The wake-skating sheet construction 14 can be placed on top of the board construction 12 so as to cover all the attachment members 24. The attachment device in the form of the loop material 44 engages with the attachment device in the form of the attachment members 24. Each one of the hook-shaped upper ends of the attachment members 24 hooks into one or more loops of the loop material 44. Because of engagement of the loop material 44 with the attachment members 24, the wake-skating sheet 40 is prevented from moving laterally in a horizontal direction relative to the sport board 20.

The upper major surface 47 of the wake-skating sheet 40 provides a relatively smooth surface for a rider to stand upon. The upper major surface 47 is substantially free of any attachment members such as the attachment members 24, or any loop material such as the loop material 44. The upper major surface 47 thus does not attach to a foot of a person standing on the upper major surface 47 or to a footpiece worn by the person, at least not to the extent that the wake-skating sheet cannot separate from the foot or the footpiece due to the gravity of the board construction 12 in combination with the wake-skating sheet construction 14. The person is thus permitted to jump up and down relative to the upper major surface 47. The upper major surface 47 does provide sufficient friction to keep the person from slipping on the upper major surface 47.

Figure 4:
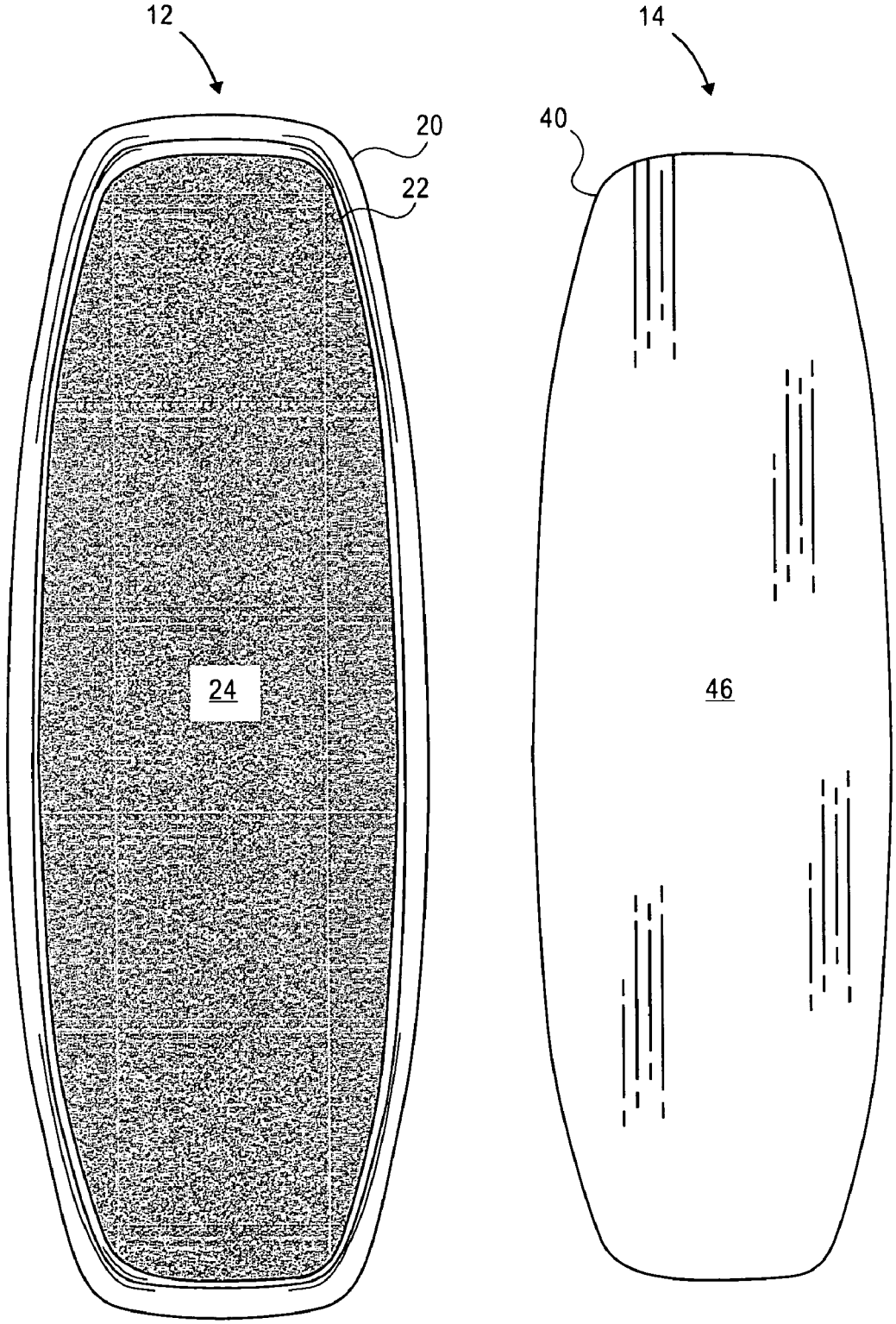
FIG. 4 is a top plan view of the sporting system in the configuration of FIG. 1.

FIG. 4 illustrates the board construction 12 and the wake-skating sheet construction 14 side-by-side. A majority of the upper major surface 30 (see FIG. 1) of the sport board 20 is covered with the hook backing material 22. The hook backing material 22 may conveniently be made out of strips that are located side-by-side. The attachment members 24 cover substantially the entire hook backing material 22. The wake-skating sheet 40 corresponds substantially in size to the hook backing material 22, and the loop material 44 covers substantially the entire lower major surface 48 of the wake-skating sheet 40. The wake-skating sheet 40 covers all the attachment members 24, and is attached to the attachment members 24 across substantially the entire area of the wake-skating sheet 40. It is within the scope of the invention that there may be a few of the attachment members 24 that are visible outside a periphery of the wake-skating sheet 40, typically less than ten percent of all the attachment members 24.

The sporting system 10 in the configuration of FIG. 1 can conveniently be used as a wake-skate. The board construction 12 has the same shape and dimensions as a conventional wake-skating board. Wake-skating is an adaptation of wake-boarding that employs a similar design of board. Unlike wake-boarding, a rider is not bound to the board in any way. Riders usually wear shoes while riding, to afford themselves extra traction on the board, similar to skateboarding. A rider can be towed behind a boat or a jet-ski, or a winch can be used to pull the rider.

In the configuration of FIG. 2, a rider can be attached to the board construction 12, thereby allowing the rider to do a set of tricks that cannot be accomplished with a conventional wake-skating board or the sporting system 10 in the configuration of FIG. 1. In order to convert from the configuration of FIG. 1 to the configuration of FIG. 2, the wake-skating sheet construction 14 is first removed from the board construction 12. A person lifts an edge of the wake-skating sheet construction 14 from the board construction 12. Bending of the wake-skating sheet construction 14 allows for the attachment members 24 to be progressively separated from the loop material 44, until the entire wake-skating sheet construction 14 is removed from the board construction 12.

The shoe construction 18 in FIG. 2 includes a sole portion 56, a shoe upper 58, a tongue 60, a lace 62, and attachment members 64. The shoe upper 58 is peripherally attached to a periphery of the sole portion 56. The tongue 60 is also attached to the shoe upper 58. The shoe upper 58, together with the tongue 60, define a foot opening 65 through which a person can insert a foot into the shoe upper 58. The shoe upper 58 also has eyelets 66. The lace 62 is threaded through the eyelets 66 in a zig-zag pattern over the tongue 60. Opposing ends 68 of the lace 62 can be tied together. In an alternate shoe construction, a closing/fitting device other than laces can be used, for example a short belt with a Velcro®-type attachment or other type of attachment. The sole portion 56, together with the shoe upper 58, the tongue 60, and the lace 62, thus form a footpiece to be worn on a foot of a person.

The attachment members 64 have upper ends that are secured to a hook backing material 70, and lower ends that are hook-shaped. The attachment members 64 and the hook backing material 70 are commonly known as "hook-type Velcro®." An upper major surface of the hook backing material 70 is bonded to a lower major surface of the sole portion 56. The attachment members 64 thus form an attachment device on a lower side of the shoe construction 18.

The intermediate sheet construction 16 includes first and second intermediate sheets 74 and 76, and loop material 80 and 82. The loop material 80 is located on a lower major surface of the first intermediate sheet 74. The loop material 80 and the first intermediate sheet 74 are also known as "loop-type Velcro®." The loop material 82 is located on an upper major surface of the second intermediate sheet 76. The loop material 82 and the second intermediate sheet 76 are also known as "loop-type Velcro®." A lower major surface of the second intermediate sheet 76 is located on an upper major surface of the first intermediate sheet 74. The sheets 76 and 74 are glued and stitched to one another to finalize the construction of the intermediate sheet construction 16.

The intermediate sheet construction 16 is located on top of the board construction 12. Each one of the attachment members 24 hooks onto one or more loops of the loop material 80. A construction formed by the board construction 12 and the intermediate sheet construction 16 is provided with an attachment device in the form of the loop material 82 at the top.

A rider wearing the shoe construction 18 steps onto the intermediate sheet construction 16. The attachment members 64 hook onto loops of the loop material 82. The intermediate sheet construction 16 and the board construction 12 are then attached to the shoe construction 18 and to a foot of the rider.

Figure 5:
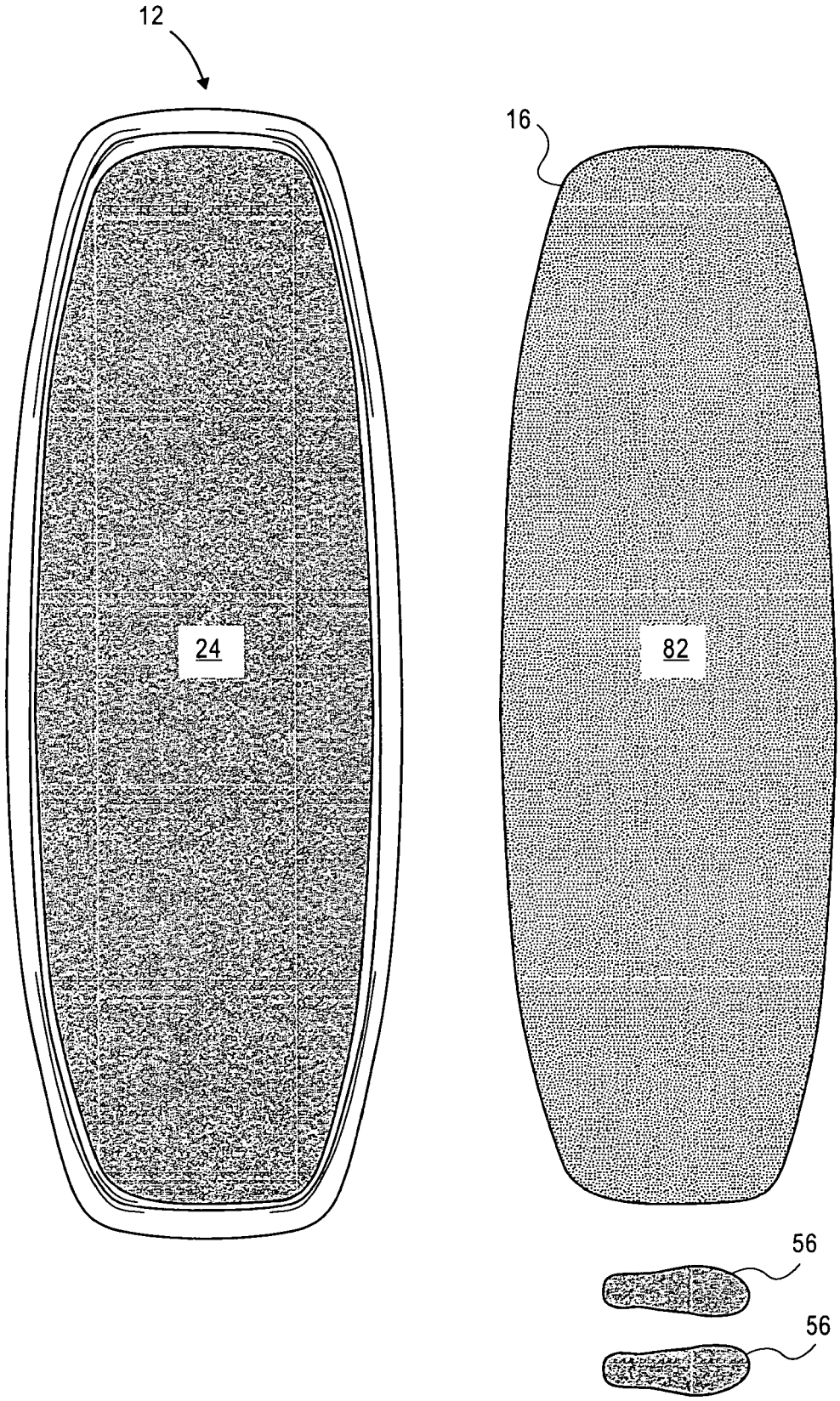
FIG. 5 is a top plan view of the sporting system in the configuration of FIG. 2.

As shown in FIG. 5, the intermediate sheet construction 16 covers approximately the same surface area as the attachment members 24 of the board construction 12. More specifically, the loop material 80 (see also FIG. 2) and the loop material 82 cover areas that are approximately the same area as the area covered by the attachment members 24. Two shoe constructions 18 are provided, each with a respective sole portion 56. Each sole portion 56 covers an area that is substantially less than ten percent of an area covered by the loop material 82. The corresponding attachment members 64 cover the same area as the respective sole portions 56. Because of the smaller area of the sole portions 56 compared to the area of the attachment members 24, the sole portions 56 will release with more ease from the loop material 82 than the loop material 82 from the attachment members 24. The intermediate sheet construction 16 will thus remain on the board construction 12, even when the rider steps off the intermediate sheet construction 16. The attachment between the sole portion 56 and the intermediate sheet construction 16 is still sufficiently strong to allow the rider to perform jumps and other tricks without having the intermediate sheet construction 16 release from the sole portions 56. Specifically, the attachment between the sole portion 56 and the intermediate sheet construction 16 is sufficient to prevent the intermediate sheet construction 16 and the board construction 12 from separating from the sole portion 56 under gravity. The person can still release the sole portion 56 from the intermediate sheet construction 16 by lifting a heel of the sole portion 56 and progressively peeling the sole portion 56 from the intermediate sheet construction 16. The sole portions 56 can be removed from the intermediate sheet construction 16 one at a time.

Loop-type Velcro® wears out and loses its effectiveness after repeated use. The loop material 82 in FIG. 2 is particularly susceptible to wear, because a person will step onto and off of the loop material 82 or adjusts the positioning of the shoe construction 18 on the loop material 82 more frequently than, for example, the attachment or detachment of the loop material 80 or the loop material 44. Because the intermediate sheet construction 16 is a removable piece, the loop material 82 can thus be replaced. It will also be understood why hook-type Velcro® is chosen to be permanently attached in the board construction 12 and the shoe construction 18 in a permanent fashion, and why loop-type Velcro® is chosen for the more temporary intermediate sheet construction 16, namely because hook-type Velcro® wears at a much slower rate than loop-type Velcro®.

Figure 6:
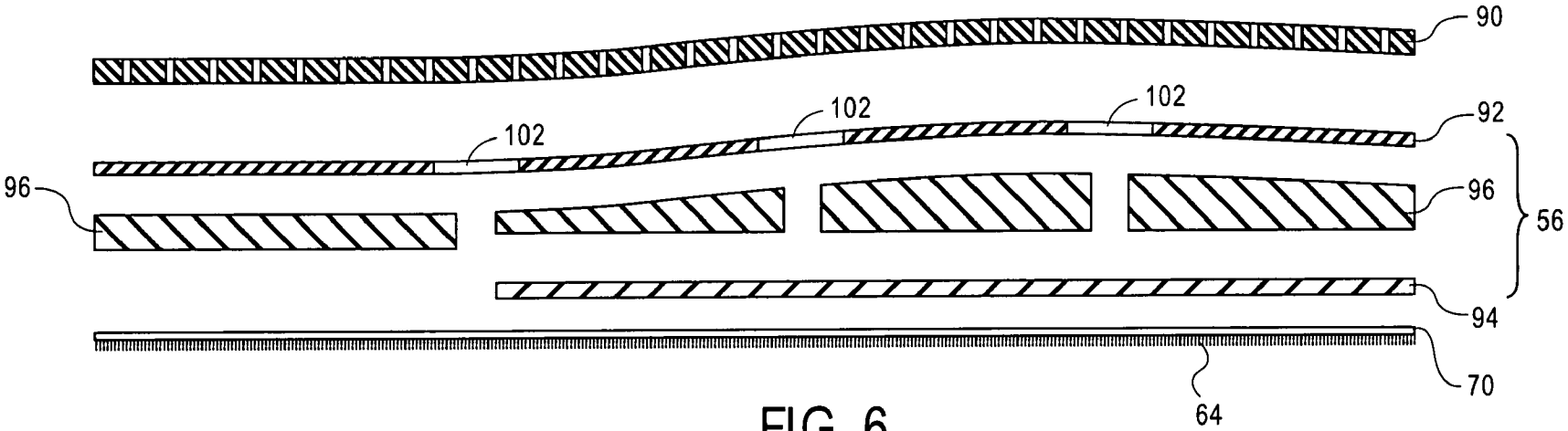
FIG. 6 is a cross-sectional side view illustrating hook backing material with attachment members thereon, components of a sole portion, and an inner sole of the shoe construction of the sporting system in the configuration of FIG. 2, illustrating the components thereof in exploded form.

FIG. 6 illustrates the hook backing material 70 with the attachment members 64 thereon, components of the sole portion 56, and an inner sole 90 in exploded form. The sole portion 56 includes upper and lower structural pieces 92 and 94 respectively, and a plurality of drain-defining members 96.

Figure 7:
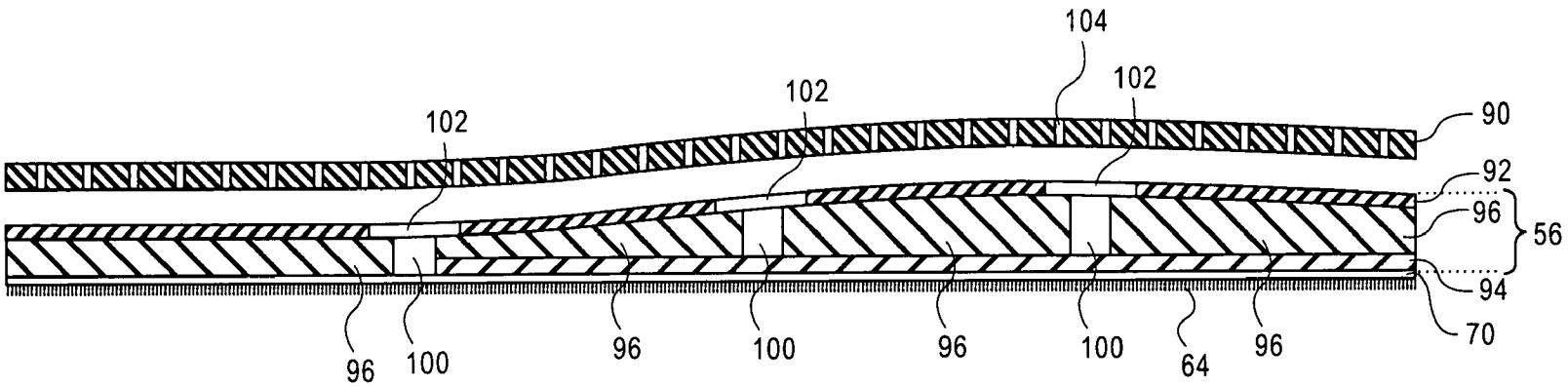
FIG. 7 is a view similar to FIG. 6 of the components after some of the components are attached to one another.

Referring to FIG. 7, the drain-defining members 96 are located between the upper and lower structural pieces 92 and 94, and are bonded to the upper and lower structural pieces 92 and 94, typically using glue. The hook backing material 70 is attached to a lower major surface of the lower structural piece 94.

A plurality of horizontal drains 100 is defined between respective pairs of the drain-defining members 96. Each horizontal drain 100 has two opposing openings, each at a respective edge of the sole portion 56. The upper structural piece 92 has a plurality of vertical drains 102 formed therein. Each one of the vertical drains 102 is in communication with a respective one of the horizontal drains 100.

The inner sole 90 has a plurality of vertical drain holes 104 formed therethrough. Some of the drain holes 104 are formed above the vertical drains 102, and some are formed in areas that are not above the vertical drains 102. The inner sole 90 is a replaceable piece that is not bonded to the upper structural piece 92.

In use, water located above the inner sole 90 can flow through the drain holes 104 into a space between the inner sole and the upper structural piece 92, and then flow through the space into the vertical drains 102. Some of the water can also flow directly through the vertical drain holes 104 located above the vertical drains 102 into the vertical drains 102. The water then flows from the vertical drains 102 into the horizontal drains 100 and horizontally out of the sole portion 56.

Figure 8:
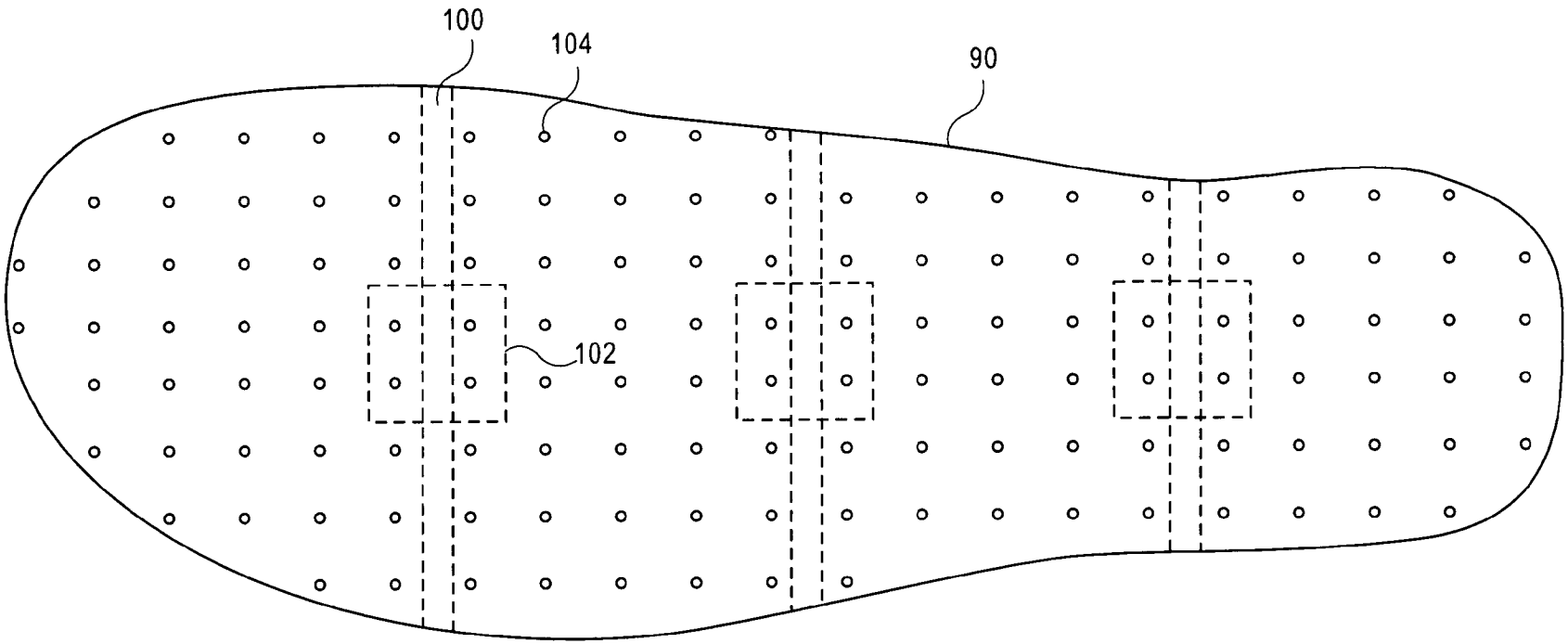
FIG. 8 is a top plan view of the components shown in FIG. 7.

As shown in FIG. 8, the vertical drain holes 104 form a square matrix across an entire surface of the inner sole 90. The vertical drains 102 are formed along a spine of the sole portion 56. Each one of the vertical drains 102 is substantially square. The horizontal drains 100 are longer than the vertical drains 102, so that the water enters near a spine of the sole portion 56 into the horizontal drains, and then flows laterally to opposing edges of the sole portion 56.

Figure 9:
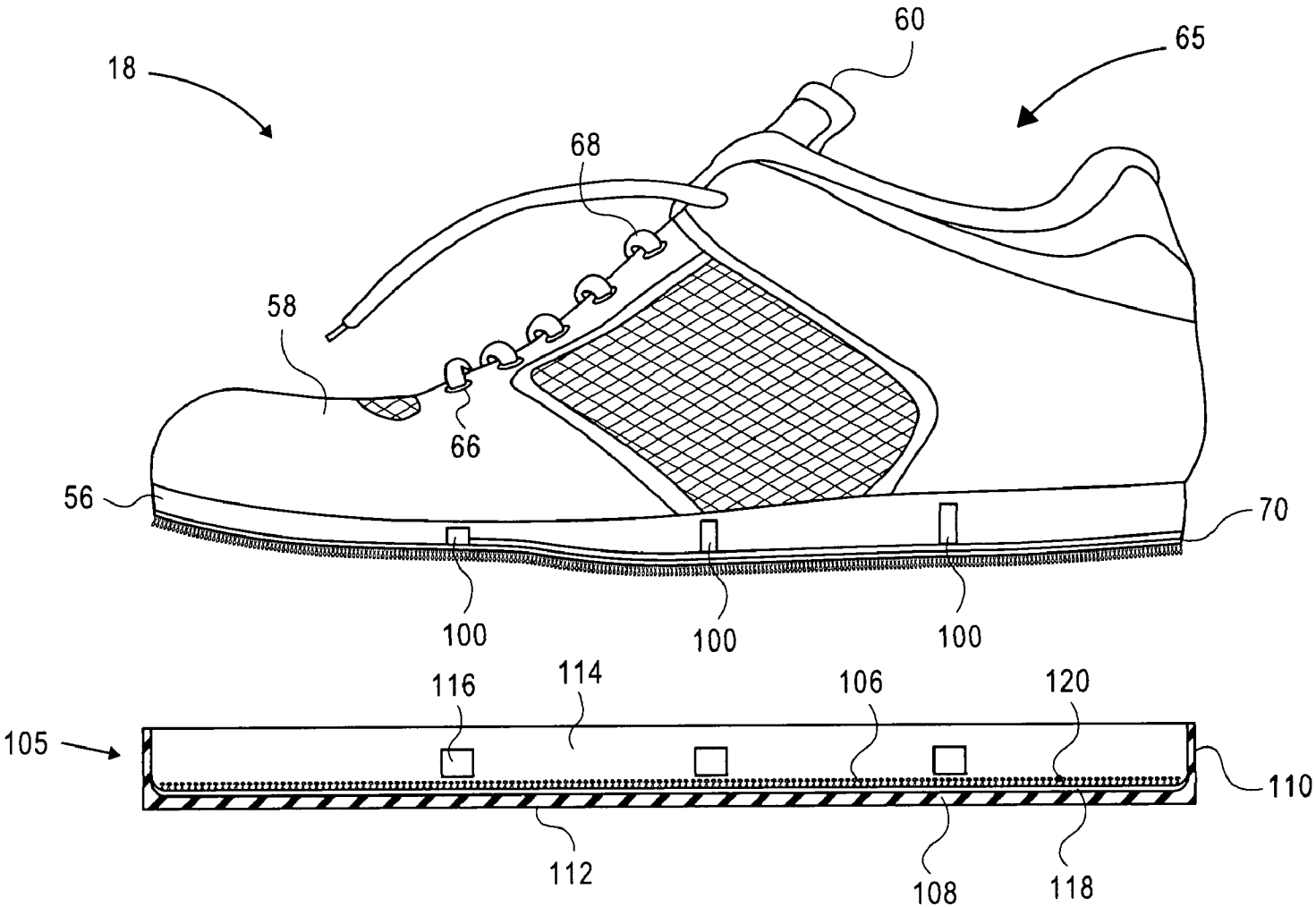
FIG. 9 is a side view of a shoe system that includes the shoe construction of FIG. 2, and further illustrates a replaceable sole member.

FIG. 9 illustrates the shoe construction 18 of FIG. 2, and further shows a sole member 105 and loop-type Velcro® 106.

The sole member 105 has a lower portion 108 and a side portion 110, and is made of a rubberized material. The lower portion 108 has a lower major surface 112 that has a non-slip pattern formed thereon, as is conventional for sneakers, running shoes, boating shoes, or wake-skating shoes. The side portion 110 extends upward from an entire periphery of the lower portion 108. The side portion 110 and the lower portion 108 form a recessed shape 114. When viewed from above, the recessed shape 114 corresponds in shape and size to a shape and size of the foot outline of the sole portion 56. The shoe construction 18 can be sized to fit the foot of a particular rider, and the sole member 105 would match the particular size of the particular shoe construction 18. Horizontal drain passages 116 are formed in the side portion 110.

The loop-type Velcro® 106 includes a loop backing sheet 118 and loop-type material 120 on the loop backing sheet 118. A lower major surface of the loop backing sheet 118 is permanently attached to an upper major surface of the lower portion 108.

A rider, after stepping off the intermediate sheet construction 16 of FIG. 2, can immediately step into the recessed shape 114 of the sole member 104. The attachment members 64 hook onto loops of the loop-type material 120, thereby attaching the sole member 105 to the shoe construction 18. The lower major surface 112 provides the person with traction that is sufficient for purposes of walking on relatively slippery surfaces, and traction that is sufficient for purposes of wake-skating using the sporting system 10 in the configuration shown in FIG. 1. The lower major surface 112 is free of any attachment devices, at least to the extent that the attachment devices will keep the intermediate sheet construction 16 and the board construction 12 from separating under gravity. The lower major surface 112 is thus a different type of surface than what is provided by the attachment members 64. The person is thus provided with a walking, wake-skating, or boating shoe without the need for replacing shoes.

The side portion 110 wraps around a portion of the shoe upper 58 of the shoe construction 18, to give it the appearance of a conventional sneaker. Each one of the horizontal drain passages 116 lines up with a respective mouth of one of the horizontal drains 100. Water leaving a horizontal drain 100 is expelled through one of the horizontal drain passages 116. The horizontal drain passages 116 thus further assist in expelling water after the person has left the water, e.g., after using the sporting system 10 in the configurations of FIG. 1 or 2.

The sporting system 10 as illustrated and discussed with reference to FIGS. 1 through 9 thus permits a person to switch back and forth between a wake-skating configuration as shown in FIG. 1, where the person would not be attached to the board construction 12, and a configuration as shown in FIG. 2, where the person would be attached to the board construction 12. As discussed with reference to FIG. 5, the configuration of FIG. 2 allows for a person to be attached to a board having the same dimensions and features of a wake-skating board.

The system shown in FIG. 2 can also find application in wake-boarding. In conventional wake-boarding, a rider is attached to a single board, known as a wake-board, with a bolted-down, non-release boot binding for each foot, and standing sideways as on a snowboard or a skateboard. The boots are heavy and sometimes painful to wear. It can also be cumbersome to get into and out of the boots. The boots also do not allow a rider much room for adjusting the location of a foot on the wake-board.

FIGS. 10-14 illustrate a kit that can be used for converting a conventional wake-board to a sporting system having a Velcro®-type attachment between board and rider.

Figure 10:
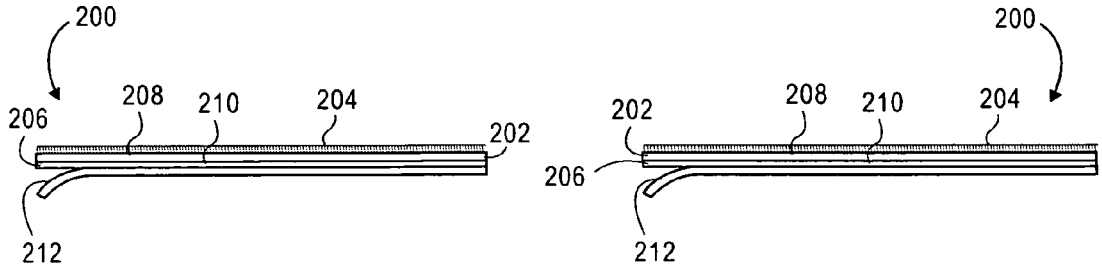
FIG. 10 is a side view of two hook-type attachment pieces forming part of a kit for converting a conventional wake-board to a sporting system, having a Velcro®-type attachment between board and rider.
Figure 11:
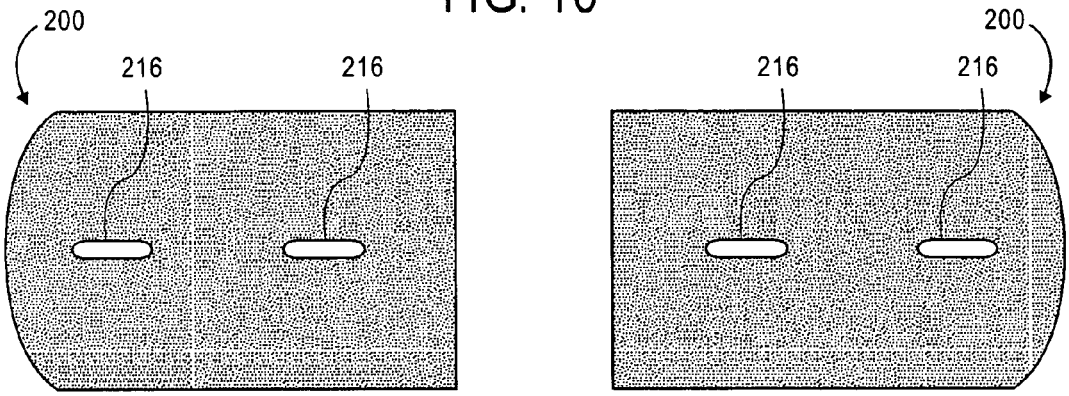
FIG. 11 is a plan view of the attachment pieces of FIG. 10.

Referring specifically to FIGS. 10 and 11, the kit includes two hook-type attachment pieces 200. Each hook-type attachment piece 200 includes a hook backing material 202, attachment members 204, adhesive 206, and a cover sheet 212. Each attachment member 204 has a lower end that is attached to the hook backing material 202, and an upper end that is hook-shaped. The combination of the attachment members 204 and the hook backing material 202 is commonly known as "hook-type Velcro®." The hook backing material 202 has upper and lower major surfaces 208 and 210, respectively.

The cover sheet 212 has upper and lower major surfaces. The cover sheet 212 is typically made of paper, and the upper major surface thereof is temporarily attached via the adhesive 206 to the lower major surface 210 of the hook backing material 202. It will be appreciated that the hook-type attachment piece 200 is common hook-type Velcro®, as it is commonly provided with a cover sheet over the adhesive.

The hook-type attachment piece 200 is cut into a generally rectangular shape, with one short edge that is rounded. The hook-type attachment piece 200 is typically approximately 18 inches long, and approximately 12 inches wide. Two elongated holes 216 are formed through the hook-type attachment piece 200, i.e., through the hook backing material 202, adhesive 206, and cover sheet 212.

Figure 12:
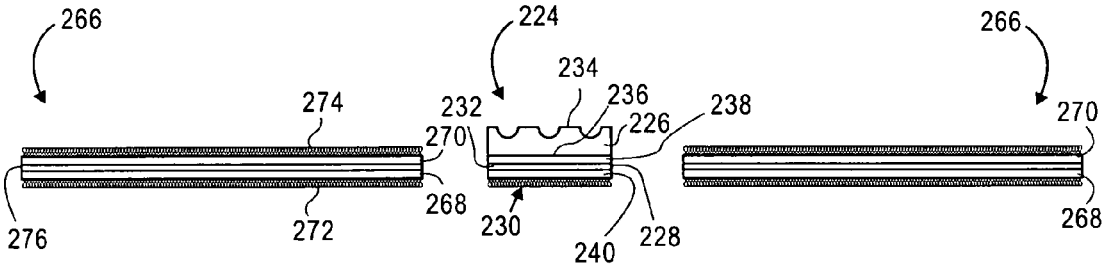
FIG. 12 is a side view of a center pad construction and two intermediate sheet constructions forming part of the kit.
Figure 13:
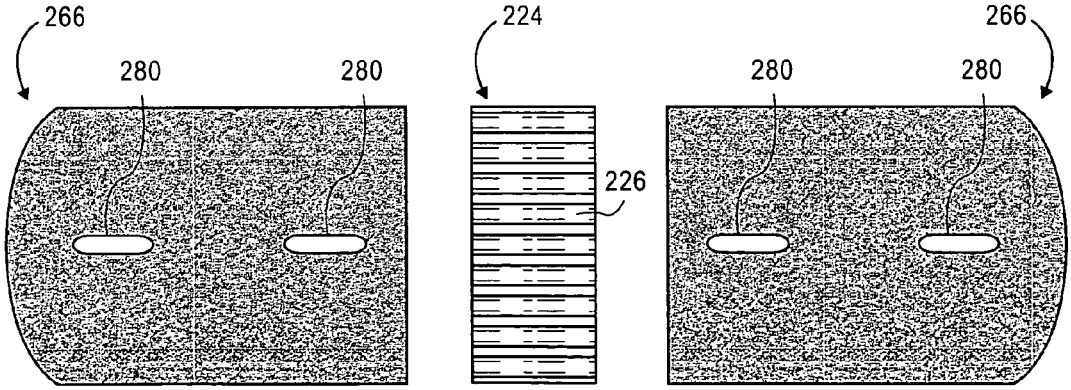
FIG. 13 is a plan view of the center pad construction and the two intermediate sheet constructions of FIG. 12.

Referring to FIGS. 12 and 13, the kit further includes a center pad construction 224, including a center pad 226, loop backing material 228, loop material 230, and an adhesive 232.

The center pad 226 is made of a synthetic rubber material or other relatively flexible material. The center pad 226 has upper and lower major surfaces 234 and 236, respectively.

The loop backing material 228 has upper and lower major surfaces 238 and 240, respectively. The loop material 230 is attached to the lower major surface 240 of the loop backing material 228. The combination of the loop backing material 228 and the loop material 230 is commonly known as "loop-type Velcro®." The adhesive 232 is located between the upper major surface 238 of the loop backing material 228 and the lower major surface 236 of the center pad 226, and attaches the loop backing material 228 to the center pad 226. The loop material 230 is thus attached through the loop backing material 228 and the adhesive 232 to the lower major surface 236 of the center pad 226. The center pad 226 is thus provided with an attachment device in the form of the loop material 230 on a lower side thereof.

The center pad construction 224 has a generally rectangular shape, with a width of approximately five inches and a length of approximately 12 inches.

As further illustrated in FIGS. 12 and 13, the kit further includes two intermediate sheet constructions 266. In fact, more intermediate sheet constructions may be included in the kit for purposes of replacement, should one of the intermediate sheet constructions 266 become worn out.

Each intermediate sheet construction 266 includes first and second intermediate sheets 268 and 270, loop material 272 and 274, and an adhesive 276. The loop material 272 is located on a lower major surface of the first intermediate sheet 268. The loop material 272 and the first intermediate sheet 268 are also known as loop-type Velcro®. The loop material 274 is located on an upper major surface of the second intermediate sheet 270. The loop material 274 and the second intermediate sheet 270 are also known as "loop-type Velcro®." A lower major surface of the second intermediate sheet 270 is located on an upper major surface of the first intermediate sheet 268. The sheets 268 and 270 are bonded to one another with the adhesive 276 and stitched to one another to finalize the construction of the intermediate sheet construction 266.

The intermediate sheet construction 266 is generally rectangular in shape, with one short edge that is rounded. The intermediately sheet construction 266 has a length of approximately 15 inches and a width of approximately 12 inches. Openings 280 are made through the intermediate sheet construction 266.

Figure 14:
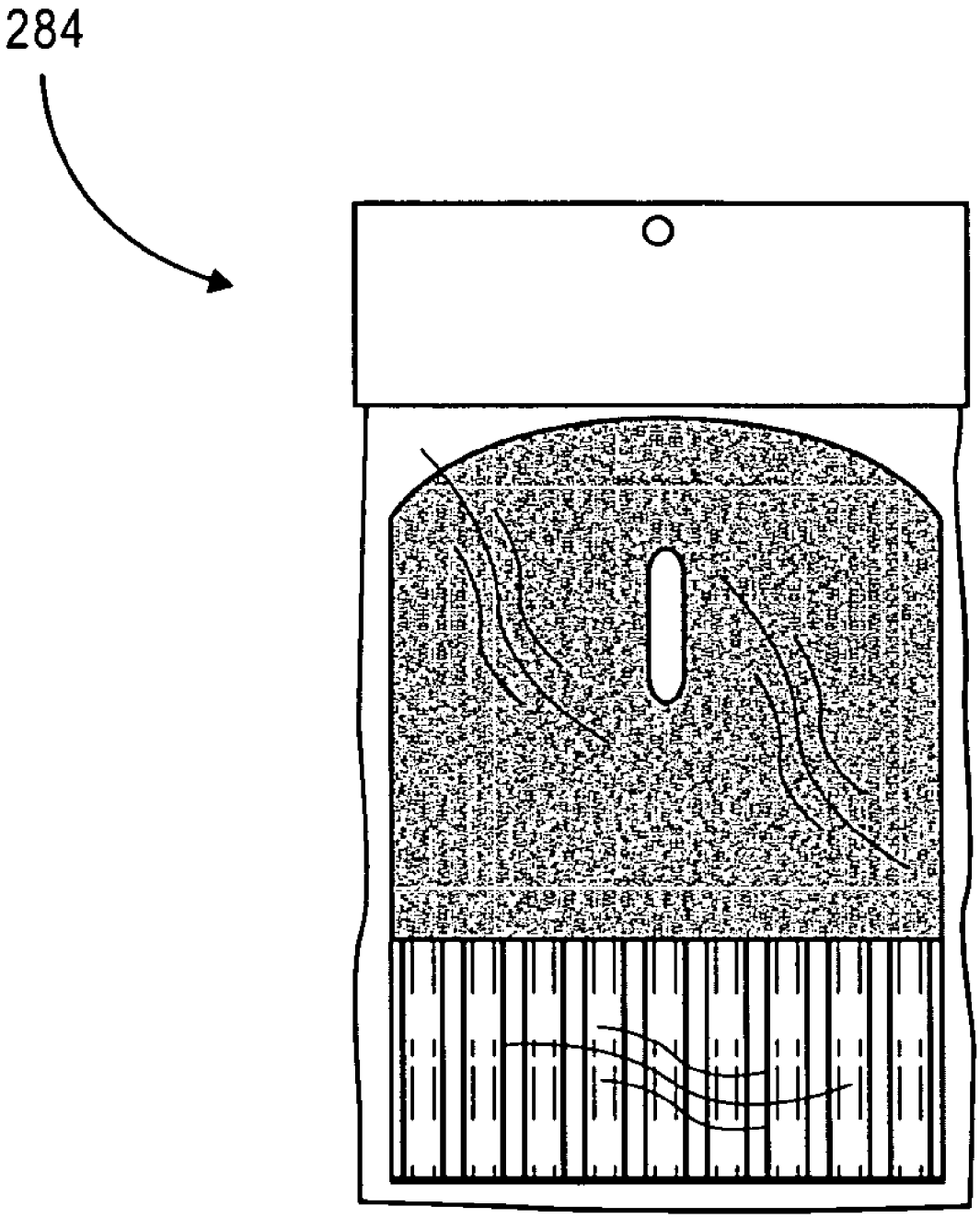
FIG. 14 is a side view of a bag that forms part of the kit.

FIG. 14 illustrates a container in the form of a bag 284 that forms part of the kit. The two hook-type attachment pieces 200 of FIGS. 10 and 11, the center pad construction 224 of FIGS. 12 and 13, and the two intermediate sheet constructions 266 of FIGS. 12 and 13, and spare intermediate sheet constructions are all placed within the bag 284. The bag 284 is then closed for purposes of shipment and off-the-rack sales.

Figure 15:
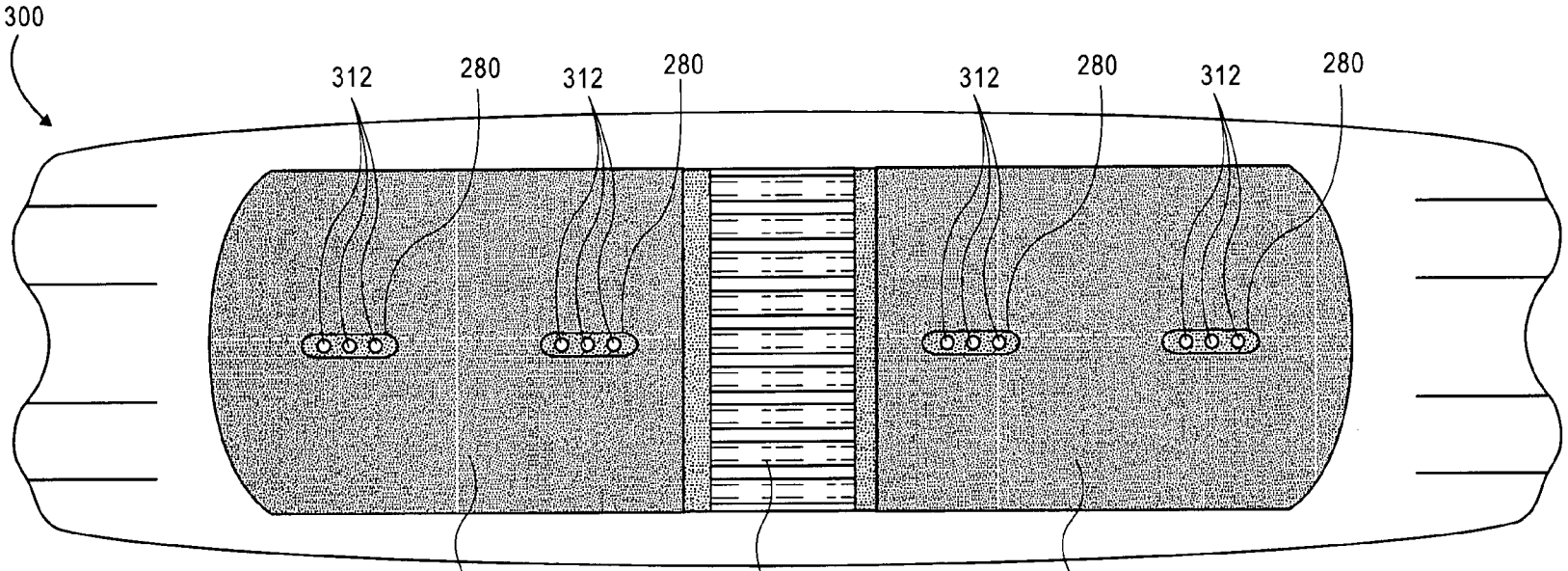
FIG. 15 is a plan view of a sporting system that includes a conventional wake-board and components of the kit of FIGS. 10 to 13.
Figure 16:
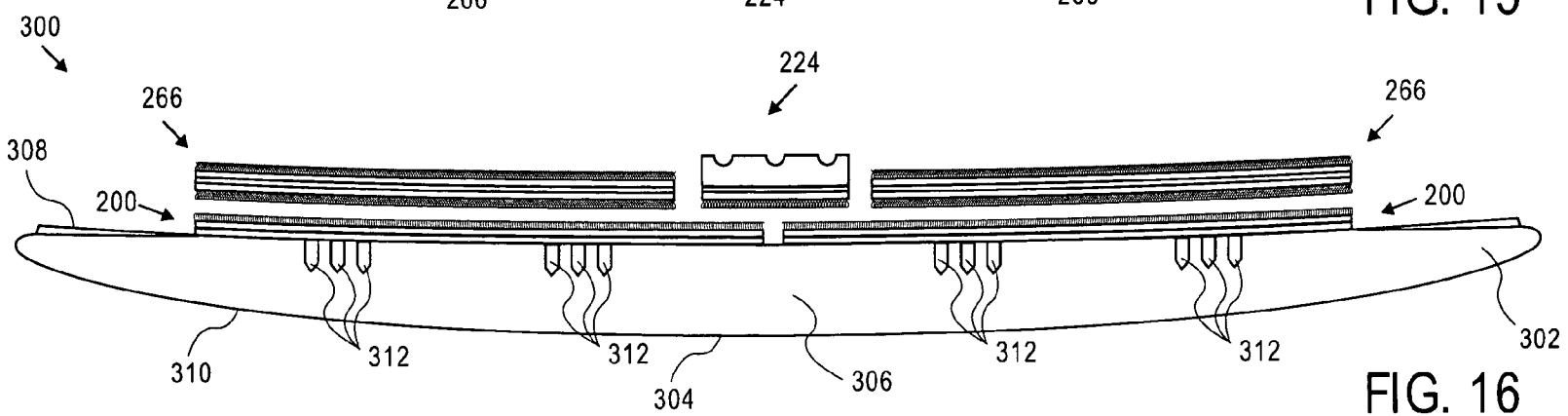
FIG. 16 is a side view of the sporting system of FIG. 15.

FIGS. 15 and 16 illustrate a sporting system 300, according to another embodiment of the invention, including a wake-board 302 and the components of the kit illustrated in FIGS. 10-13.

A purchaser of the kit, i.e., the bag 284 of FIG. 14 and the components of FIGS. 10 to 13 within the bag 284, would typically already be in possession of a wake-board such as the wake-board 302. The wake-board 302 has an outer shell 304 and an inner core 306 made of Styrofoam or another buoyant material that keeps the wake-board 302 afloat with at least a portion of the wake-board 302 above water. The wake-board 302 has an upper major surface 308 and a lower major surface 310.

The person purchasing the kit removes the components of FIGS. 10 to 13 from the bag 284 in FIG. 14. The person then peels the cover sheet 212 from the adhesive 206 of one of the hook-type attachment pieces 200. Because of the nature of the materials of the hook backing material 202 and the cover sheet 212, the adhesive 206 sticks or adheres more firmly to the hook backing material 202 than the cover sheet 212. The adhesive 206 is thus still present on the lower major surface 210 of the hook backing material 202. Because the adhesive 206 is now exposed, the adhesive 206 is positioned on top of the upper major surface 308 of the wake-board 302. The adhesive 206 thus attaches the lower major surface 210 of the hook backing material 202 to the upper major surface 308 of the wake-board 302. The attachment members 204 thus have lower ends that are secured through the hook backing material 202 and the adhesive 206 to the upper major surface 308 of the wake-board 302. The attachment members 204 thus form an attachment device on the wake-board 302.

The process described hereinbefore with respect to attaching one of the hook-type attachment pieces 200 to the wake-board 302 is then repeated for attaching the other hook-type attachment piece 200 to the upper major surface 308 of the wake-board 302. Straight, short edges of the two hook-type attachment pieces 200 abut one another.

The intermediate sheet constructions 266 and the center pad construction 224 are then positioned on top of the hook-type attachment pieces 200. The center pad construction 224 is positioned over abutting edges of the hook-type attachment pieces 200 approximately in a center of the wake-board 302. The intermediate sheet constructions 266 are positioned on opposing sides of the center pad construction 224. Some of the attachment members 204 hook onto the loop material 272 of the intermediate sheet constructions 266, and some of the attachment members 204 hook onto the loop material 230 of the center pad construction 224. Because of the engagement of the loop materials 272 and 230 with the attachment members 204, the center pad construction 224 and the intermediate sheet constructions 266 are prevented from moving laterally in a horizontal direction relative to the wake-board 302.

The upper major surface 234 of the center pad 226 provides a relatively smooth surface for a rider to stand on, and is sized so that a rider can stand thereon with one foot. The upper major surface 234 is substantially free of any attachment members such as the attachment members 204, or any loop material such as the loop material 230. The upper major surface 234 thus does not attach to a foot of a person standing on the upper major surface 234, or to a footpiece worn by the person, at least not to the extent that the center pad 226 cannot separate from the foot or the footpiece, due to the gravity of the wake-board 302 in combination with the center pad construction 224, intermediate sheet constructions 266, and the hook-type attachment pieces 200. The person is thus permitted to move the foot up and down relative to the upper major surface 234. The upper major surface 234 thus provides sufficient friction to keep the person from slipping on the upper major surface 234.

The construction formed by the wake-board 302 and the intermediate sheet constructions 266 is provided with an attachment device in the form of the loop material 274 at the top. A rider wearing a shoe construction such as the shoe construction 18 steps onto the intermediate sheet construction 266. The attachment members 64 hook onto loops of the loop material 274. The intermediate sheet construction 266 and the wake-board 302 are thereby attached to the shoe construction 18 of a foot of the rider.

The intermediate sheet constructions 266, together with the center pad construction 224, cover approximately the same surface area as the attachment members 204. The loop material 274 covers areas that, in combination, are smaller than an area covered by the attachment members 204.

Two shoe constructions, such as the shoe construction 18, are provided, each with a respective sole portion 56. Each sole portion 56 covers an area that is substantially less than ten percent of an area covered by the loop material 274. The corresponding attachment members 204 cover the same area as the respective sole portions 56. Because of the smaller area of the sole portions 56 compared to the area of the attachment members 204, the sole portions 56 will release with more ease from the loop material 274 than the loop material 272 from the attachment members 204. The intermediate sheet constructions 266 will thus remain on the wake-board 302, even when the rider steps off the intermediate sheet constructions 266. The attachment between the sole portion 56 and one of the intermediate sheet constructions 266 is still sufficiently strong to allow the rider to perform jumps and other tricks without having the intermediate sheet construction 266 release from the sole portions 56. Specifically, the attachment between the sole portion 56 and the intermediate sheet construction 266 is sufficient to prevent the intermediate sheet construction 266 and the wake-board 302 from separating from the sole portion 56 under gravity. The rider can still release the sole portion 56 from the intermediate sheet construction 266 by lifting a heel of the sole portion 56 and progressively peeling the sole portion 56 from the intermediate sheet construction 266. The sole portions 56 can be removed from the intermediate sheet constructions 266 one at a time.

The wake-board 302 has a plurality of threaded openings 312 in the upper major surface 308. The threaded openings 312 are a feature of all wake-boards, and are there so that bindings can be screwed into the wake-board 302. On the present wake-board 302, there are four groups of three of the threaded openings 312. Two of the groups are located forward of center of the wake-board 302, and two of the groups are located behind center of the wake-board 302. The elongated holes 216 in the hook-type attachment pieces 200 are located over a respective group of the threaded openings 312. Similarly, the openings 280 of the intermediate sheet constructions 266 are aligned with the respective groups of the threaded openings 312.

Figure 17:
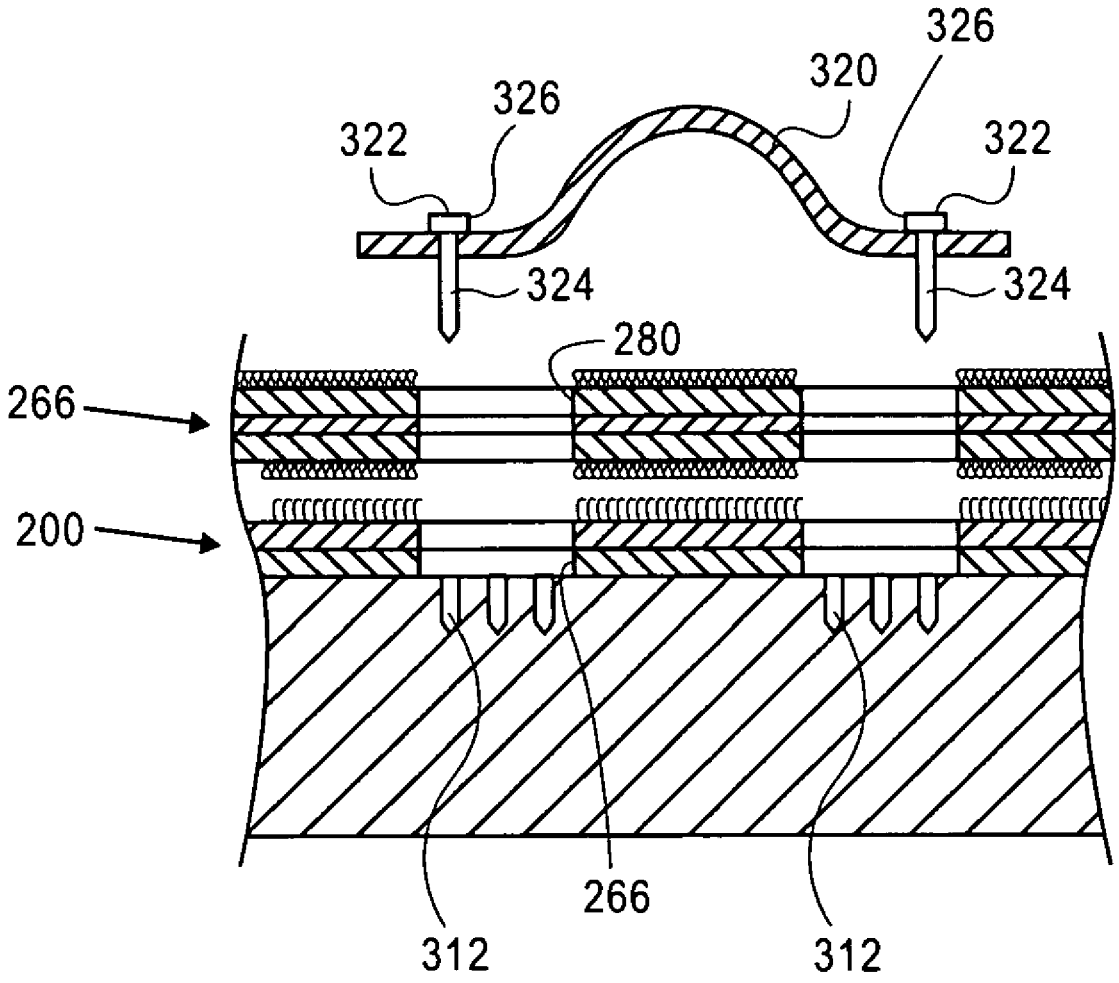
FIG. 17 is a side view illustrating a strap that can optionally be used in the sporting system of FIGS. 15 and 16.

Referring to FIG. 17, a strap 320 and two fasteners 322 may be provided. Each fastener 322 has a threaded shank 324 and a head 326 on the threaded shank 324. The threaded shanks 324 are inserted through openings at opposing ends of the strap 320. The heads 326 are then used to screw the threaded shanks 324 into the threaded openings 312. Each threaded shank 324 screws into only one respective threaded opening 312 of a respective group of the openings 312 of FIG. 16. The heads 326 seat on the strap 320 to keep ends of the strap 320 down. A length of the strap 320 between the threaded shanks 324 is longer than a distance between the threaded shanks 324, to leave a loop opening for a foot or a footpiece to be inserted. The footpiece may be a shoe such as the shoe construction 18 in FIG. 2, with or without the sole member 105 shown in FIG. 9.

In an alternate embodiment, the hook-type attachment pieces 200 and the intermediate sheet constructions 266 entirely cover the threaded openings 312.

Figure 18:
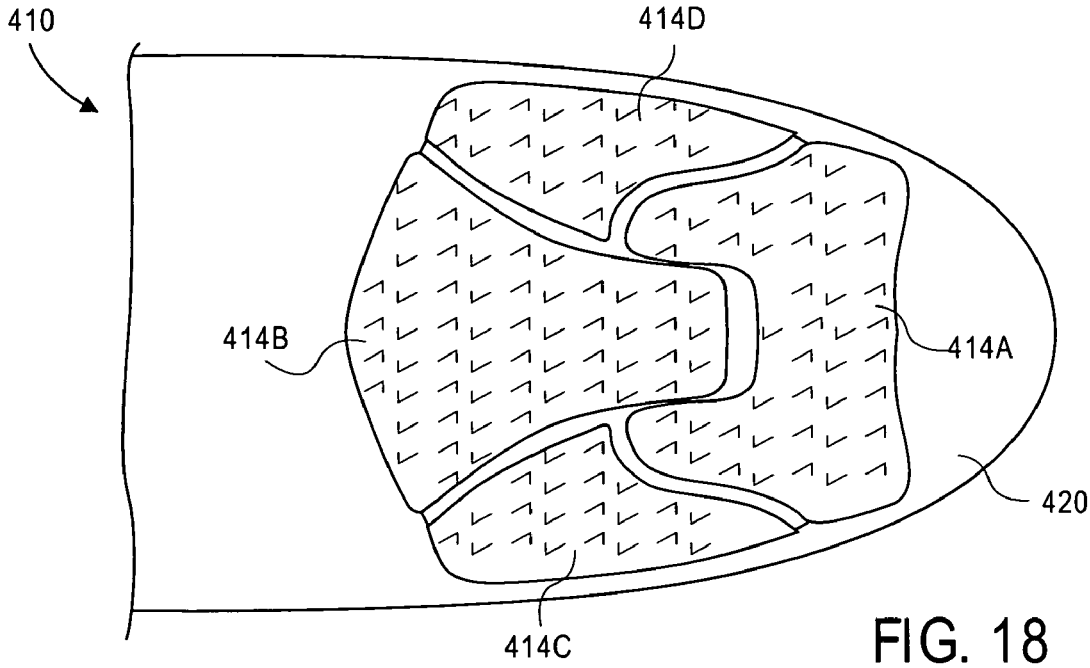
FIG. 18 is a top plan view of a sporting system, according to a further embodiment of the invention, including a surfboard and replaceable traction pads.
Figure 19:
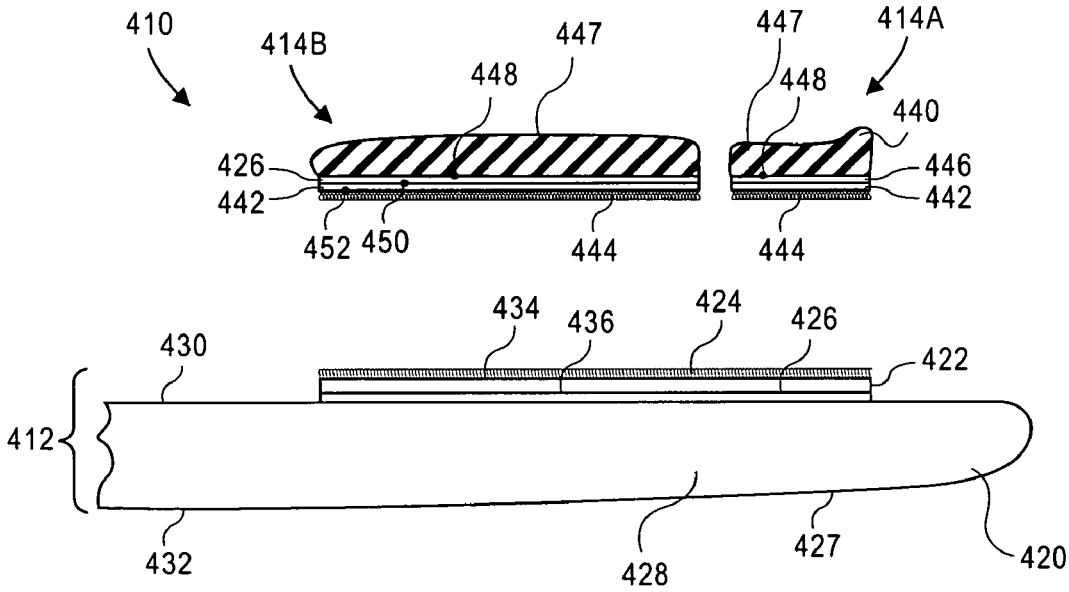
FIG. 19 is a cross-sectional side view of the sporting system of FIG. 18.

FIGS. 18 and 19 illustrate a sporting system 410, according to a further embodiment of the invention, including a board construction 412 and four traction pad constructions A, B, C, and D.

The sport board construction 412 includes a surfboard 420, a hook backing material 422, attachment members 424, and adhesive 426.

The surfboard 420 has an outer shell 427 and an inner core 428 made of Styrofoam or another buoyant material that keeps the board construction 412 afloat with at least a portion of the board construction 412 above water. The surfboard 420 has an upper major surface 430 and a lower major surface 432.

Each attachment member 424 has a lower end that is attached to the hook backing material 422, and an upper end that is hook-shaped. The combination of the attachment members 424 and the hook backing material 422 is commonly known as "hook-type Velcro®." The hook backing material 422 has upper and lower major surfaces 434 and 436, respectively. The adhesive 426 is located between and attaches the lower major surface 436 of the hook backing material 422 to the upper major surface 430 of the surfboard 420. The attachment members 424 thus have lower ends that are secured through the hook backing material 422 and the adhesive 426 to the upper major surface 430 of the surfboard 420. The attachment members 424 thus form an attachment device on the surfboard 420.

Each one of the traction pad constructions 414A, B, C, or D includes a traction pad 440, loop backing material 442, loop material 444, and an adhesive 446.

The traction pad 440 is made of a synthetic rubber material or another relatively flexible material compared to the surfboard 420. The traction pad 440 has upper and lower major surfaces 447 and 448.

The loop backing material 442 has upper and lower major surfaces 450 and 452. The loop material 444 is attached to the lower major surface 452 of the loop backing material 442. The combination of the loop backing material 442 and the loop material 444 is commonly known as "loop-type Velcro®." The adhesive 446 is located between the upper major surface 450 of the loop backing material 442 and the lower major surface 448 of the traction pad 440, and attaches the loop backing material 442 to the traction pad 440. The loop material 444 is thus attached through the loop backing material 442 and the adhesive 446 to the lower major surface 448 of the traction pad 440. The traction pad 440 is thus provided with an attachment device in the form of the loop material 444 on a lower side thereof.

The traction pad constructions 414A, B, C, and D can be placed on top of the board construction 412 so as to jointly cover all of the attachment members 424. The attachment device in the form of the loop material 444 of each traction pad construction 414A, B, C, and D engages with the attachment device in the form of the attachment members 424. Each one of the hook-shaped upper ends of the attachment members 424 hooks into one or more loops of the loop material 444. Because of engagement of the loop material 444 with the attachment members 424, the traction pads 440 of the traction pad constructions 414A, B, C, and D are prevented from moving laterally or in a horizontal direction relative to the surfboard 420.

The upper major surface 447 of each traction pad 440 provides a relatively smooth surface for a rider to stand on. The upper major surface 447 is substantially free of any attachment members such as the attachment members 424, or any loop material such as the loop material 444. The upper major surface 447 thus does not attach to a foot of a person standing on the upper major surface 447 or to a footpiece worn by the person, at least not to the extent that the respective traction pad 440 cannot separate from the foot or the footpiece due to gravity of the board construction 412 in combination with the traction pad constructions 414A, B, C, and D. The rider is thus permitted to jump up and down relative to the upper major surface 447. The upper major surface 447 is a non-slip surface that does provide sufficient friction to keep the person from slipping on the upper major surface 447.

The traction pad construction 414A is located at a rear of the surfboard 420, and provides a back kick for a surfer. The traction pad construction 414B is located forward of the traction pad construction 414A, and provides a center arch. The traction pad constructions 414A and 414B are located on a center line of the surfboard 420, and the traction pad constructions 414C and 414D are located to the side of the traction pad constructions 414A and 414B, away from the center line of the surfboard 420. The traction pad constructions 414C and 414D provide side kicks.

Each one of the traction pad constructions 414A to D has an upper major surface 447 that is profiled. The profiles of the upper major surfaces 447 are dictated by varying thicknesses of the traction pads 440 of the respective traction pad constructions 414A, B, C, and D. The profiles of the traction pad constructions 414C and 414D in cross-sectional side view are the same. However, the profiles of the traction pad constructions 414A, B, and C all differ from one another in cross-sectional side view. With specific reference to FIG. 18, the shapes of the traction pad constructions 414A, B, C, and D are also all different in plan view. A surfer can conveniently replace one of the traction pad constructions 414A, B, C, or D with another traction pad construction having the same shape in plan view, but having a different profile in side view. For example, the surfer can replace the traction pad construction 414A with a traction pad construction (not shown) having the same shape as the traction pad construction 414A in the plan view of FIG. 18, but which is thicker and has a different profile than the upper major surface 447 of the traction pad construction 414A in side view. In this manner, the surfer can customize the heights and profiles of one or more of the traction pad constructions 414A, B, C, or D. The traction pad constructions 414A, B, C, and D can also be sold as a kit. The following table provides examples of kits that can be sold:

| | Kit 1 | Kit 2 | Kit 3 |
|---|---|---|---|
| Traction Pad Construction 414A | 18 mm thick | 26 mm thick | 18 mm thick |
| Traction Pad Construction 414B | 10 mm thick | 8 mm thick | 5 mm thick |
| Traction Pad Construction 414C | 0 mm thick | 5 mm thick | 3 mm thick |
| Traction Pad Construction 414D | 0 mm thick | 5 mm thick | 3 mm thick |

A surfer may also choose to replace all the traction pad constructions 414A-D with a single traction pad construction that covers approximately the same area as the traction pad constructions 414A, B, C, and D in combination.

Figure 20:
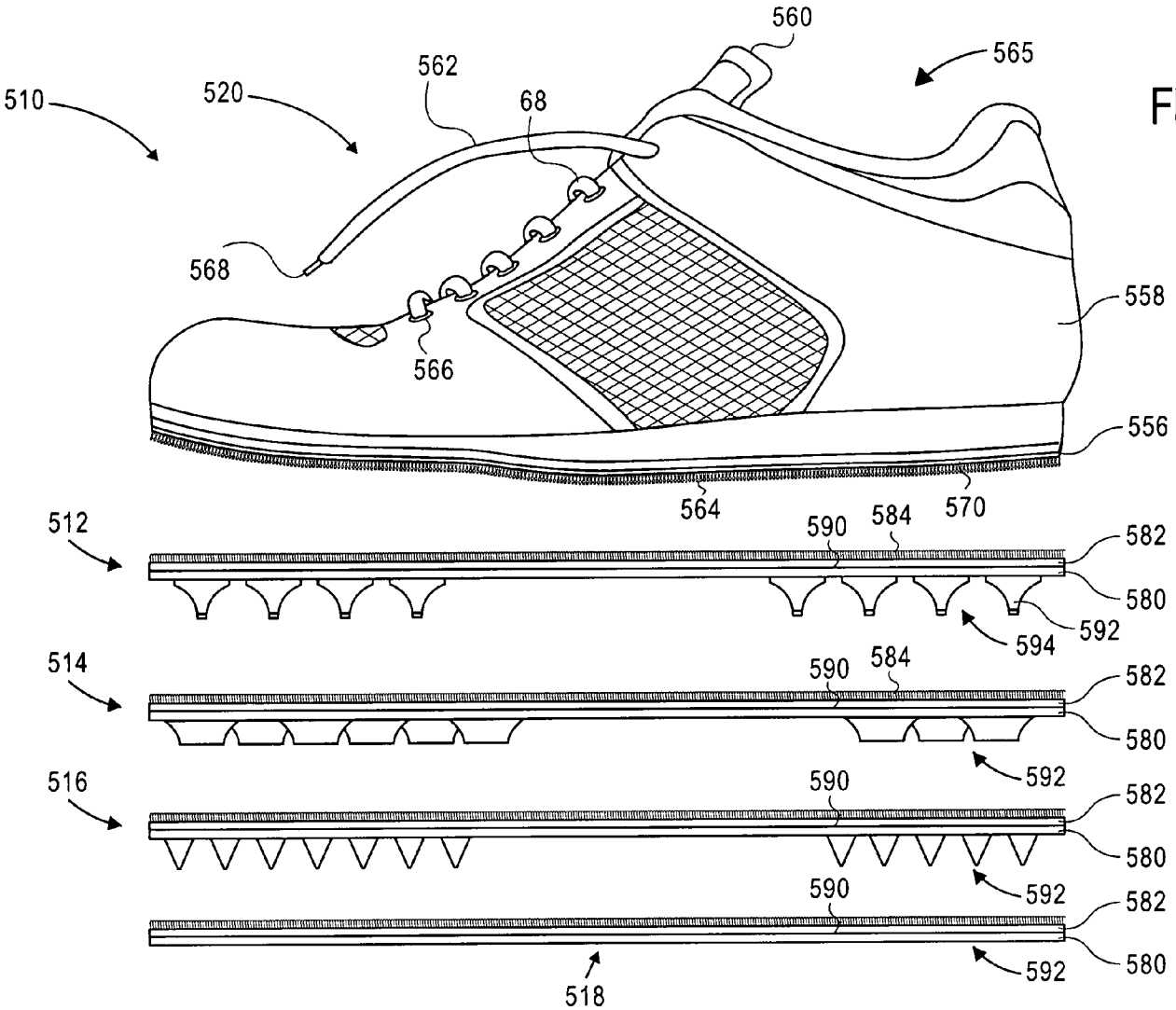
FIG. 20 is a side view illustrating a shoe system, according to a further embodiment of the invention, including a shoe construction and replaceable sole constructions for purposes of providing traction on different types of surfaces.

FIG. 20 illustrates a shoe system 510, according to an embodiment of the invention, including a shoe construction 520, a golf spike-type replaceable sole construction 512, a sport cleat-type replaceable sole construction 514, an ice-spike-type replaceable sole construction 516, and a walking or casual-wear-type replaceable sole construction 518.

The shoe construction 520 includes a sole portion 556, a shoe upper 558, a tongue 560, a lace 562, and attachment members 564. The shoe upper 558 is peripherally attached to a periphery or edge of the sole portion 556. The tongue 560 is also attached to the shoe upper 558. The shoe upper 558 together with the tongue 560 define a foot opening 565 through which a person can insert a foot into the shoe upper 558. The shoe upper 558 also has eyelets 566. The lace 562 is threaded in a zig-zag pattern through the eyelets 566 and over the tongue 560. Opposing ends 568 of the lace 562 can be tied together. The sole portion 556, together with the shoe upper 558, the tongue 560, and the lace 562, thus form a footpiece to be worn on a foot of a person.

The attachment members 564 have upper ends that are secured to a hook backing material 570, and lower ends that are hook-shaped. The attachment members 564 and the hook backing material 570 are commonly known as "hook-type Velcro®." An upper side of the hook backing material 570 is bonded to a lower surface of the sole portion 556. The attachment members 564 thus form an attachment device on a lower side of the shoe construction 520.

Each one of the replaceable sole constructions 512, 514, 516, and 518 includes a sole member 580, loop backing material 582, and loop material 584. The loop material 584 is attached to the loop backing material 582. The loop material 584 together with the loop backing material 582 is commonly known as "loop-type Velcro®." The sole member 580 has upper and lower major surfaces 590 and 592, respectively. A lower side of the loop backing material 582 is attached to an upper surface of the sole member 580.

The attachment members 564 provide an attachment device on a lower side of the sole portion 556 of the shoe construction 520. The loop material 584 of the replaceable sole constructions 512, 514, 516, and 518 provide an attachment device on an upper side of each one of the sole members 580. The sole members 580 can be attached to the shoe construction 520 by attaching the loop material 584 to the attachment members 564. Moreover, the respective replaceable sole construction, for example, the golf spike-type replaceable sole construction 512 can be removed from the shoe construction 520, and the walking or casual-wear replaceable sole construction 518 can be attached to the shoe construction 520. Each one of the replaceable sole constructions 512, 514, 516, and 518 has a different lower major surface 592. The golf-spike-type replaceable sole construction 512, for example, has a plurality of spikes 594. The lower major surface 592 of the walking or casual-wear-type replaceable sole construction 518 does not have any protrusions or cleats or spikes, and is made of a synthetic rubber material. The golf-spike-type replaceable sole construction 512 will provide better traction on a first select surface, such as wet grass, than the walking or casual-wear-type replaceable sole construction 518, but the walking or casual-wear-type replaceable sole construction 518 will provide better traction on another select surface, such as a metal surface or another smooth, hard surface. The lower major surfaces 592 of the sport-cleat-type replaceable sole construction 514 have cleats, and the lower major surfaces 592 of the ice-spike-type replaceable sole construction 516 have a plurality of spikes because of better traction on surfaces on which they are used. The replaceable sole constructions 512, 514, 516, and 518 are all sized to fit the shoe construction 520. A larger shoe construction will have correspondingly larger replaceable sole constructions.

While certain exemplary embodiments have been described and shown in the accompanying drawings, it is to be understood that such embodiments are merely illustrative and not restrictive of the current invention, and that this invention is not restricted to the specific constructions and arrangements shown and described since modifications may occur to those ordinarily skilled in the art.

What is claimed:

1. A sporting system, comprising:

a board, having upper and lower major surfaces;

a first attachment device in the form of a plurality of attachment members having lower ends attached to the upper major surface of the board, and upper ends that are hook-shaped for purposes of removable attachment to a second attachment device in the form of loop material;

an intermediate sheet having upper and lower major sides;

the second attachment device in the form of loop material on the lower major surface of the intermediate sheet for removable attachment to the first attachment device;

a third attachment device in the form of loop material on the upper major surface of the intermediate sheet;

a footpiece to be worn on a foot of a person; and a fourth attachment device in the form of a plurality of attachment members having upper ends attached to a sole portion of the footpiece, and lower ends that are hook-shaped for purposes of removable attachment to the loop material of the third attachment device.

2. The sporting system of claim 1, wherein the board is at least partially made of a buoyant material to keep the board at least partially above water.

3. The sporting system of claim 1, further comprising:

a hook backing material, the lower ends of the attachment members being attached to the hook backing material, the hook backing material being attached to the upper major surface of the board.

4. The sporting system of claim 3, further comprising:

a first adhesive between the hook backing material and the upper major surface of the board.

5. The sporting system of claim 1, wherein the intermediate sheet has a surface area that is larger than a surface area of the sole portion of the footpiece.

6. The sporting system of claim 1, wherein the intermediate sheet is a first intermediate sheet and the loop material of the second attachment device is attached to the first intermediate sheet, further comprising a second intermediate sheet, the loop material of the third attachment device being attached to the second intermediate sheet, a lower major surface of the second intermediate sheet being attached to an upper major surface of the first intermediate sheet.

7. The sporting system of claim 1, wherein the footpiece, in addition to the sole portion, includes:

a shoe upper that is peripherally attached to the sole portion and defining a foot opening for inserting the foot, and a plurality of eyelets;

a tongue attached to the shoe upper; and a lace that is threaded through the eyelets in a zig-zag pattern across the tongue.

8. The sporting system of claim 1, wherein the sole portion has a vertical and a horizontal drain opening to allow for removal of water from within the footpiece.

9. The sporting system of claim 1, further comprising hook backing material, the upper ends of the attachment members of the fourth attachment device being attached to the hook backing material, an upper major surface of the hook backing material being attached to the sole portion of the footpiece.

10. The sporting system of claim 1, further comprising:

a sole member, having upper and lower major surfaces; and a fifth attachment device in the form of loop material on the upper major surface of the sole member for purposes of removable attachment to the fourth attachment device, after removal of the fourth attachment device from the second attachment device.

11. The sporting system of claim 10, wherein the lower major surface of the sole member is substantially free of attachment devices that will prevent the board from separating from the footpiece under gravity.

12. The sporting system of claim 1, further comprising:

a wake-skating sheet, having upper and lower major surfaces; and a second attachment device in the form of loop material on a lower major surface of the wake-skating sheet, for removable attachment to the first attachment device.

13. The sporting system of claim 12, wherein the upper major surface of the wake-skating sheet is exposed and substantially free of attachment devices that will prevent the board from separating from a footpiece under gravity.

14. The sporting system of claim 13, further comprising:

loop backing material, the loop material of the second attachment device being secured to the loop backing material, an upper major surface of the loop backing material being attached to a lower major surface of the wake-skating sheet.

15. A sporting system, comprising:

a board, having upper and lower major surfaces;

a first attachment device attached to the upper major surface of the board;

a footpiece to be worn on a foot of a person;

a second attachment device on the footpiece for removable attachment to the first attachment device;

a wake-skating continuous sheet of material having upper and lower major surfaces; and a third attachment device on the lower major surface of the wake-skating sheet for removable attachment to the first attachment device after detachment of the second attachment device from the first attachment device, wherein the wake-skating sheet covers substantially all of the upper major surface of the board.

16. The sporting system of claim 15, wherein the upper major surface of the wake-skating sheet is exposed and substantially free of attachment devices that will prevent the board from separating from a footpiece under gravity.

17. A sporting system, comprising:

a board, having upper and lower major surfaces, wherein the board is at least partially made of a buoyant material to keep the board at least partially above water;

a first attachment device attached to the upper major surface of the board;

at least a first upper traction pad having upper and lower major surfaces;

a second attachment device on the lower major surface of the upper traction pad, for removable attachment to the first attachment device, the upper major surface of the first upper traction pad being exposed and substantially free of attachment devices that will prevent the board from separating from a shoe under gravity at least a second upper traction pad, having upper and lower major surfaces; and a third attachment device on the lower major surface of the second upper traction pad for removable attachment to the first attachment device, the upper major surface of the second upper traction pad being exposed and substantially free of attachment devices that will prevent the board from separating from a shoe under gravity, wherein the upper major surfaces of the first and second upper traction pads have different profiles.

18. The sporting system of claim 17, wherein the upper major surface of the first upper traction pad is a non-slip surface.

19. The sporting system of claim 17, wherein the first and second upper traction pads are simultaneously attached to the first attachment device at different locations on the upper major surface of the board.

20. The sporting system of claim 17, further comprising:

a hook backing material, the first attachment device being a plurality of attachment members, each having a lower end attached to the hook backing material, and an upper end that is hook-shaped, the second attachment device being loop material.

21. The sporting system of claim 20, further comprising:

a first adhesive between the hook backing material and the upper major surface of the board.

22. A shoe system, comprising:

a footpiece worn on a foot of a person with the footpiece having a sole portion;

a first attachment device on the footpiece;

a first sole member, having upper and lower major surfaces;

a second attachment device on the first sole member, for removable attachment to the first attachment device;

a second sole member, having upper and lower major surfaces; and a third attachment device on the second sole member, for removable attachment to the first attachment device, the lower major surface of the first sole member providing better traction on a first select surface than the lower major surface of the second sole member, wherein the first sole member has a plurality of horizontal drain openings aligned with horizontal drain openings of the sole portion for expelling water from the footpiece when the footpiece is not in water.

23. The shoe system of claim 22, wherein the lower major surface of the second sole member provides better traction on a second select surface than the first sole member.

24. The shoe system of claim 22, wherein the lower major surface of the first sole member includes a plurality of protrusions, and the lower major surface of the second sole member does not include a plurality of protrusions.

25. The shoe system of claim 22, wherein the footpiece includes:

a shoe upper that is peripherally attached to the sole portion and defining a foot opening for inserting the foot, and a plurality of eyelets;

a tongue attached to the shoe upper; and a lace that is threaded through the eyelets in a zig-zag pattern across the tongue.

26. The shoe system of claim 22, wherein at least one of the first attachment device, the second attachment device, and the third attachment device includes a loop material, and one of the first attachment device, the second attachment device, and the third attachment device includes hook material.

27. A shoe system, comprising:

a footpiece worn on a foot of a person with the footpiece having a sole portion;

a first attachment device on the footpiece;

a sole member, including a lower portion having upper and lower major surfaces and a sole portion extending upwardly from the lower portion, past at least a portion of the footpiece; and a second attachment device on the sole member, for removable attachment to the first attachment device, wherein the sole member has a plurality of horizontal drain openings aligned with horizontal drain openings of the sole portion for expelling water from the footpiece when the footpiece is not in water.

28. The shoe system of claim 27, wherein the footpiece includes:

a shoe upper that is peripherally attached to the sole portion and defining a foot opening for inserting the foot, and a plurality of eyelets;

a tongue attached to the shoe upper; and a lace that is threaded through the eyelets in a zig-zag pattern across the tongue.

* * * * *